US008124190B2

(12) United States Patent
Miyasaka

(10) Patent No.: US 8,124,190 B2
(45) Date of Patent: Feb. 28, 2012

(54) METHOD FOR DISCHARGING LIQUID MATERIAL, METHOD FOR MANUFACTURING COLOR FILTER, AND METHOD FOR MANUFACTURING ORGANIC EL ELEMENT

(75) Inventor: Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 873 days.

(21) Appl. No.: 12/169,107

(22) Filed: Jul. 8, 2008

(65) Prior Publication Data

US 2009/0027430 A1 Jan. 29, 2009

(30) Foreign Application Priority Data

Jul. 24, 2007 (JP) ..... 2007-191677

(51) Int. Cl.
*B05D 1/02* (2006.01)

(52) U.S. Cl. ..... 427/427.2; 427/64; 347/9; 347/10; 347/11; 347/12; 347/14

(58) Field of Classification Search ..... 427/64, 427/427.2; 445/24; 347/9, 10, 11, 12, 14
See application file for complete search history.

(56) References Cited

U.S. PATENT DOCUMENTS

2004/0023567 A1* 2/2004 Koyama et al. ..... 439/894
2007/0111626 A1 5/2007 Kato

FOREIGN PATENT DOCUMENTS

JP H10-193587 A 1/1998
JP 2003-159787 A 6/2003
JP 2007-152339 A 6/2007

* cited by examiner

*Primary Examiner* — George Koch
(74) *Attorney, Agent, or Firm* — Global IP Counselors, LLP

(57) ABSTRACT

A method for discharging a liquid material includes performing a scan by moving a discharge target having a film formation area and a plurality of nozzles forming a nozzle row with respect to each other, and discharging a liquid material as droplets from the nozzles onto the film formation area by selectively applying one of drive waveforms generated using time division to an energy generation element of each of the nozzles in synchronization with the scan. The discharging of the liquid material includes applying a first drive waveform to a first nozzle of the nozzle row and a second drive waveform having a different discharge timing from the first drive waveform to a second nozzle of the nozzle row with the second nozzle being adjacent to the first nozzle, and changing a combination of the first and second drive waveforms selected from the drive waveforms at least once.

9 Claims, 13 Drawing Sheets

METHOD FOR DISCHARGING LIQUID MATERIAL, METHOD FOR MANUFACTURING COLOR FILTER, AND METHOD FOR MANUFACTURING ORGANIC EL ELEMENT

CROSS-REFERENCE TO RELATED APPLICATIONS

This application claims priority to Japanese Patent Application No. 2007-191677 filed on Jul. 24, 2007. The entire disclosure of Japanese Patent Application No. 2007-191677 is hereby incorporated herein by reference.

BACKGROUND

1. Technical Field

The present invention relates to a method for discharging a liquid material containing a functional material, a method for manufacturing a color filter, and a method for manufacturing an organic EL element.

2. Related Art

Japanese Laid-Open Patent Application No. 2003-159787 discloses one known example of a method for discharging a liquid material containing a functional material, which is a method for discharging a liquid material containing a color filter material onto a substrate to manufacture a color filter.

In the aforementioned color filter manufacturing method, a plurality of droplet discharge heads having a plurality of nozzles capable of discharging a liquid material as droplets are made to face a substrate so that the nozzle rows are arranged in a specific direction. A method is used in which a liquid material is not discharged from nozzles (unused nozzles) positioned at specific areas at the ends of the nozzle rows, and the substrate and droplet discharge heads are moved correspondingly with respect to each other while the liquid material is appropriately discharged from nozzles (used nozzles) onto specific positions on the substrate to form a color filter. The liquid material is thereby discharged in a more uniform maimer, because the liquid material is discharged without using nozzles that are positioned at specific areas at the ends of the nozzle rows and that discharge comparatively large amounts.

However, in practice there have been discrepancies between nozzles in regard to the amount of droplets discharged from the plurality of nozzles in the droplet discharge heads. When these discrepancies are large, irregularities occur in the thin film formed after discharge, and if the product is a color filter, for example, the problem of color irregularities has been encountered.

One possible example of the cause of discrepancies in the discharged amount between nozzles is so-called electrical crosstalk, in which a drive voltage is irregular when applied to an energy generation element (e.g., a piezoelectric element, a heating element, or the like) for discharging the liquid material as droplets from the nozzles. Another possible example is so-called mechanical crosstalk, in which the pressure or speed of droplet discharge is different between nozzles due to differences in the flow channels via which the liquid material is supplied to the nozzles.

Japanese Laid-Open Patent Application No. 10-193587 discloses one known example of a method for preventing the occurrence of this type of crosstalk, which is an inkjet printing method in which different drive waveforms are inputted for the energy generation elements of adjacent nozzles, and the energy generation element are driven at different times.

SUMMARY

Although different drive waveforms are inputted to adjacent nozzles (energy generation element) when taking crosstalk into account, disparities sometimes occur in regard to the amount of droplets discharged in comparison with other nozzles when, among these different drive waveforms, the same drive waveform is repeatedly applied to the same nozzle in the direction in which the substrate and droplet discharge heads (plurality of nozzles) are moved correspondingly with respect to each other (main scanning direction). Therefore, if the product is a color filter, for example, streaked discharge irregularities sometimes occur in the main scanning direction.

The present invention was contrived in order to resolve at least some of the problems described above, and the present invention can be achieved as the following aspects or application examples.

A method for discharging a liquid material according to the first aspect of the invention includes performing a scan by moving a discharge target having a film formation area and a plurality of nozzles forming a nozzle row with respect to each other, and discharging a liquid material containing a functional material as droplets from the nozzles onto the film formation area by selectively applying one of a plurality of drive waveforms generated using time division to an energy generation element of each of the nozzles in synchronization with the scan. The discharging of the liquid material including applying a first drive waveform to a first nozzle of the nozzle row associated with the film formation area and a second drive waveform having a different discharge timing from the first drive waveform to a second nozzle of the nozzle row associated with the film formation area with the second nozzle being adjacent to the first nozzle, and changing a combination of the first and second drive waveforms selected from the drive waveforms at least once.

According to this method, during the scanning of the plurality of nozzles and the discharge object, droplets are discharged at a different discharge timing from adjacent nozzles associated with film formation areas from among a nozzle row composed of a plurality of nozzles. Since the combination of drive waveforms of different discharge timings applied to the energy generation element of adjacent nozzles is changed at least once, it is possible to prevent droplets having discharge amount disparities from being discharged continuously in the scanning direction as a result of nonuniformity in the discharge characteristics between adjacent nozzles. Consequently, at least electrical crosstalk in the nozzle row can be avoided, and it is possible to disperse disparities in the amount of droplets discharged in the scanning direction that occur along with the selection of the combination of drive waveforms of different discharge timings. Specifically, streaked discharge irregularities in the scanning direction can be reduced.

In the method for discharging a liquid material of the aspect described above, the performing of the scan may include performing the scan for a plurality of times, and the discharging of the liquid material may include changing the combination of the first and second drive waveforms selected from the drive waveforms with each scan.

According to this method, the combination of drive waveforms of different discharge timings applied to the energy generation element of adjacent nozzles associated with the film formation areas is changed with each of a plurality of scans; therefore, streaked discharge irregularities in the scanning direction can be further reduced.

In the method for discharging a liquid material of the aspect described above, the discharge target may have a plurality of the film formation areas arranged at least in a scanning direction, and the discharging of the liquid material may include changing the combination of the first and second drive waveforms selected from the drive waveforms with each different liquid material discharged from the nozzles.

According to this method, the combination of drive waveforms that have a different discharge timing and that are applied to the energy generation element of the adjacent nozzles associated with the film formation areas is varied with each type of liquid material in cases in which different liquid materials are discharged into the corresponding film formation areas. Therefore, disparities in the amount of droplets discharged in the scanning direction can be dispersed with each different type of liquid material. Specifically, streaked discharge irregularities in the scanning direction are not conspicuous even though different liquid materials are discharged from a plurality of nozzles.

In the method for discharging a liquid material of the aspect described above, the discharge target may have a plurality of the film formation areas arranged at least in a scanning direction, and the discharging of the liquid material may include changing the combination of the first and second drive waveforms selected from the drive waveforms with each of the film formation areas.

According to this method, disparities in the amount of droplets discharged in the scanning direction occurring along with the selection of the combination of drive waveforms of different discharge timings can be dispersed with each film formation area. Specifically, streaked discharge irregularities in the scanning direction can be prevented in each film formation area and can be made less conspicuous.

In the method for discharging a liquid material of the aspect described above, the discharging of the liquid material may include discharging the droplets into each of the film formation areas in the scanning direction from each of the first and second nozzles, and changing the combination of the first and second drive waveforms selected from the drive waveforms with each droplet discharge.

According to this method, disparities in the amount of droplets discharged in the scanning direction occurring along with the selection of the combination of drive waveforms having a different discharge timing can be dispersed with each droplet discharge. Specifically, streaked discharge irregularities in the scanning direction can be prevented in each droplet discharge and can be made even less conspicuous.

In the method for discharging a liquid material of the aspect described above, the discharging of the liquid material may include setting the combination of the first and second drive waveforms so that the number of the energy generation elements to which the first drive waveform is applied is substantially the same as the number of the energy generation elements to which the second waveform is applied.

According to this method, the number of energy generation element to which each drive waveform is applied is substantially the same, and, accordingly, the electrical loads imposed on the energy generation element of adjacent nozzles associated with the film formation areas are substantially the same. Therefore, the weakening of each drive waveform is substantially the same, and it is possible to reduce disparities in the amount of droplets discharged in the scanning direction that occur along with the selection of drive waveforms.

In the method for discharging a liquid material of the aspect described above, the discharging of the liquid material may include applying a part of the drive waveform that is generated in a prescribed cycle to the energy generation element.

According to this method, drive waveforms having a different discharge timing are applied in specific cycles to adjacent nozzles associated with the film formation areas. Therefore, electrical crosstalk is avoided, discharge conditions are uniform between each discharge timing, and the amount of droplets discharged can be stabilized in the scanning direction.

In the method for discharging a liquid material of the aspect described above, the discharging of the liquid material may include applying a part of the drive waveform that is generated within one cycle to the energy generation element.

According to this method, electrical crosstalk is avoided, and a plurality of droplets can be discharged from adjacent nozzles into the film formation areas within one cycle. Specifically, a specific amount of liquid material can be discharged into the film formation areas in a shorter amount of time.

In the method for discharging a liquid material of the aspect described above, the discharging of the liquid material may include applying a part of the drive waveform that is generated non-cyclically to the energy generation element.

According to this method, the discharge characteristics differ with each discharge timing; therefore, the amount of droplets discharged fluctuates in the scanning direction. Fluctuations in the discharge amounts in the scanning direction are thereby added to the fluctuations in the discharge amounts caused by nonuniformity in the discharge characteristics between nozzles, and fluctuations in the discharge amounts can be dispersed two-dimensionally. Such two-dimensionally dispersed discharge irregularities are less visible than streaked (one-dimensional) discharge irregularities, and as a result, the effect of making the discharge irregularities less conspicuous is achieved.

A method for manufacturing a color filter having a colored layer with at least three colors formed in a plurality of film formation areas partitioned on a substrate according to one aspect of the invention includes discharging the liquid material of at least three colors containing a colored material onto the film formation areas using the method for discharging a liquid material as described above, and solidifying the liquid material discharged onto the substrate to form the colored layer with at least three colors.

According to this method, disparities in the amount of droplets discharged in the scanning direction can be prevented, problems with color irregularities caused by streaked discharge irregularities can be reduced, and color filters can be manufactured at a good yield rate.

A method for manufacturing an organic EL element having at least a light-emitting layer formed a plurality of film formation areas partitioned on a substrate according to one aspect of the invention includes discharging the liquid material containing a light-emitting layer formation material into the film formation areas using the method for discharging a liquid material as described above, and solidifying the liquid material discharged onto the substrate to form the light-emitting layer.

According to this method, disparities in the amount of droplets discharged in the scanning direction can be prevented, problems with light-emitting irregularities or brightness irregularities caused by streaked discharge irregularities can be reduced, and organic EL elements can be manufactured at a good yield rate.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
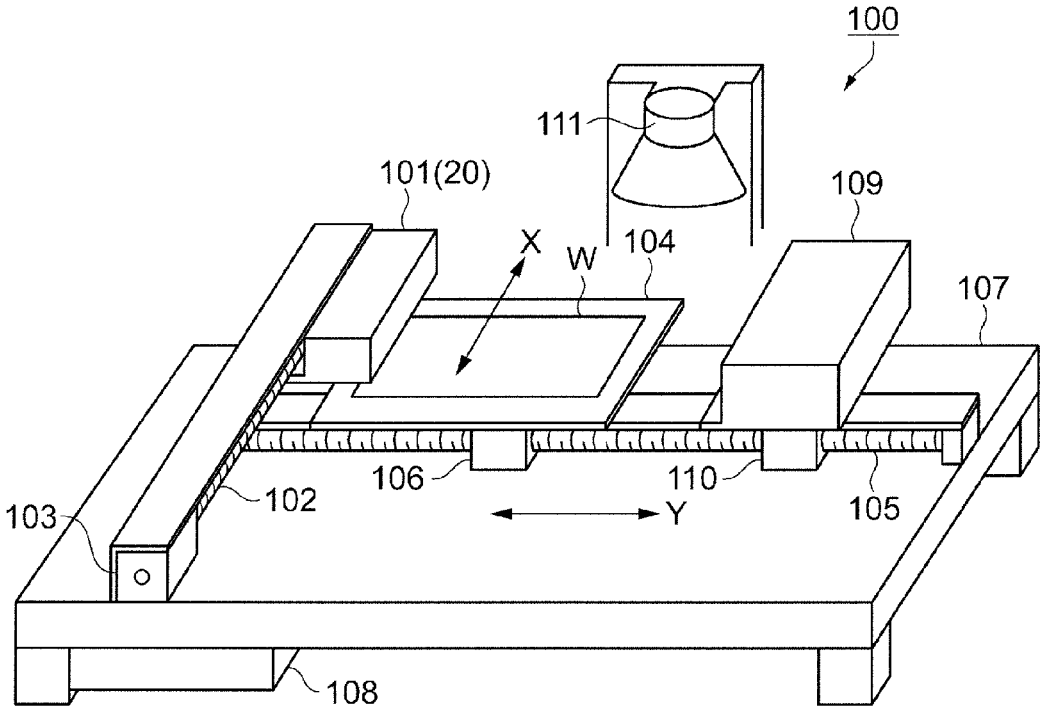
FIG. 1 is a schematic perspective view showing the configuration of a droplet discharge device.

Embodiments of the present invention are described hereinbelow with reference to the drawings. In the drawings pertaining to the following descriptions, the members are appropriately varied in scale in order to be displayed at a size that will make them recognizable.

FIRST EMBODIMENT

Droplet Discharge Device

First, the configuration of the droplet discharge device according to the present embodiment will be described with reference to FIGS. 1 through 3. FIG. 1 is a schematic perspective view showing the configuration of a droplet discharge device. A droplet discharge device 100 discharges a liquid material as droplets onto a workpiece W as a discharge target and forms a film composed of the liquid material, as shown in FIG. 1. The droplet discharge device 100 comprises a stage 104 on which the workpiece W is placed, and a head unit 101 on which are mounted a plurality of droplet discharge heads 20 (see FIG. 2) for discharging the liquid material as droplets onto the positioned workpiece W.

The droplet discharge device 100 also comprises an X-direction guide shaft 102 for driving the head unit 101 in the sub-scanning direction (X-direction), and an X-direction drive motor 103 for causing the X-direction guide shaft 102 to rotate. Also included are a Y-direction guide shaft 105 for guiding the stage 104 in the main scanning direction (Y-direction), which is perpendicular to the sub-scanning direction, and a Y-direction drive motor 106 that engages with the Y-direction guide shaft 105 and rotates. The droplet discharge device 100 comprises a base 107, on top of which are placed the X-direction guide shaft 102 and Y-direction guide shaft 105; and a control device 108 underneath the base 107.

Furthermore, the droplet discharge device 100 comprises a cleaning mechanism 109 for moving the plurality of droplet discharge heads 20 of the head unit 101 along the Y-direction guide shaft 105 in order to clean (restore) the droplet discharge heads, and a heater 111 for heating the discharged liquid material to evaporate and dry the solvent. The cleaning mechanism 109 has a Y-direction drive motor 110 that engages with the Y-direction guide shaft 105 and rotates.

The head unit 101 comprises a plurality of droplet discharge heads 20 (see FIG. 2) for coating the workpiece W with the liquid material. These droplet discharge heads 20 are capable of individually discharging the liquid material in accordance with a discharge control signal supplied from the control device 108. The droplet discharge heads 20 will be described further hereunder.

The X-direction drive motor 103 is, e.g., a stepper motor or the like, but is not limited thereto. When a drive pulse signal is supplied from the control device 108, the X-direction drive motor 103 causes the X-direction guide shaft 102 to rotate, and the head unit 101 engaged with the X-direction guide shaft 102 is moved in the X-direction.

Similarly, the Y-direction drive motors 106, 110 are, e.g., stepper motors or the like, but are not limited thereto. When a drive pulse signal is supplied from the control device 108, the Y-direction drive motors 106, 110 rotate in engagement with the Y-direction guide shaft 105, and the stage 104 and cleaning mechanism 109 comprising these motors moves in the Y-direction.

When cleaning the droplet discharge heads 20, the cleaning mechanism 109 moves to a position facing the head unit 101, and in that position performs a capping process for suctioning unnecessary liquid material adhering to the nozzle surfaces of the droplet discharge heads 20; a wiping process for wiping the nozzle surfaces to which liquid material or the like has adhered; a preliminary discharging process for discharging liquid material from all of the nozzles in the droplet discharge heads 20; or a process for receiving and expelling unnecessary liquid material. The details of the cleaning mechanism 109 are omitted.

The heater 111, though not limited to this option alone, is a device for heating the workpiece W using lamp annealing, for example, and performs a heat treatment for heating the liquid material discharged onto the workpiece W and evaporating the solvent to convert the liquid material to a film. The application and blocking of the power source for this heater 111 is also controlled by the control device 108.

In the coating operation of the droplet discharge device 100, a specific drive pulse signal is sent from the control device 108 to the X-direction drive motor 103 and the Y-direction drive motor 106, and the head unit 101 is moved in relative fashion in the sub-scanning direction (X-direction), while the stage 104 is moved in relative fashion in the main scanning direction (Y-direction). During this relative movement, a discharge control signal is supplied from the control device 108, and the liquid material is discharged as droplets from the droplet discharge heads 20 onto specific areas on the workpiece W, whereby coating is performed.

Figure 2:
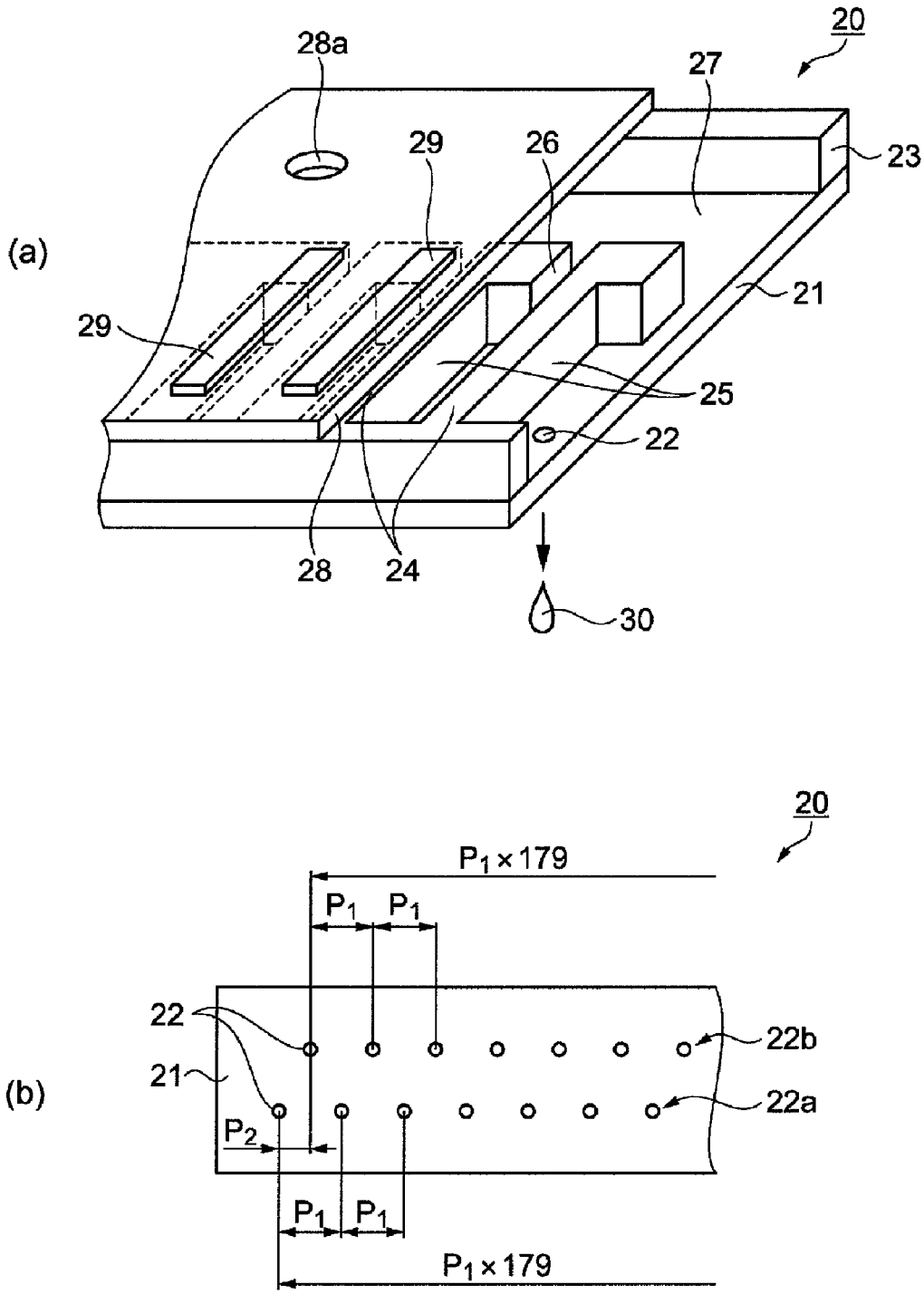
FIG. 2(*a*) is a schematic perspective view showing the structure of a droplet discharge head, and FIG. 2(*b*) is a schematic plan view showing the arrangement of a plurality of nozzles on a droplet discharge head.

FIG. 2 is a schematic view showing the structure of a droplet discharge head. FIG. 2(*a*) is a schematic perspective view showing the structure of a droplet discharge head, and FIG. 2(*b*) is a schematic plan view showing the arrangement of a plurality of nozzles in a droplet discharge head. These drawings are appropriately enlarged or reduced in size in order to clarify the configuration.

The droplet discharge head 20 is a so-called piezo inkjet head having a three-layer structure, composed of a nozzle plate 21 having a plurality of nozzles 22; a reservoir plate 23 in which flow channels for the liquid material are formed, the reservoir plate 23 containing partitions 24 that correspond to and partition the nozzles 22; and a vibrating plate 28 having piezoelectric (piezo) elements 29 as energy generation element, as shown in FIG. 2(*a*). A plurality of pressure generation chambers 25 is configured by the nozzle plate 21, the partitions 24 of the reservoir plate 23, and the vibrating plate 28. Each nozzle 22 communicates with a pressure generation chamber 25. The piezoelectric elements 29 are arranged on the vibrating plate 28 so as to correspond with the pressure generation chambers 25.

The reservoir plate 23 is provided with a common flow channel 27 for temporarily retaining liquid material supplied from a tank (not shown) through supply holes 28*a* formed in the vibrating plate 28. The liquid material that fills the common flow channel 27 is supplied to the pressure generation chambers 25 through supply ports 26.

The droplet discharge head 20 has two nozzle rows 22*a*, 22*b*, each of which has a plurality (180) of nozzles 22 arranged in a pitch $P_1$, as shown in FIG. 2(*b*). The nozzles 22 are approximately 28 μm in diameter. The two nozzle rows 22*a*, 22*b* are arranged in the nozzle plate 21 in a state of mutual misalignment at a nozzle pitch $P_2$, which is half of the pitch $P_1$. In this case, the pitch $P_1$ is approximately 140 μm. Consequently, when viewed from a direction perpendicular to the nozzle rows 22*a*, 22*b*, the 360 nozzles 22 are seen as being arranged at a nozzle pitch $P_2$ of approximately 70 μm. Therefore, the entire effective nozzle length of the droplet discharge head 20 having the two nozzle rows 22*a*, 22*b* is 359 times the nozzle pitch $P_2$ (approximately 25 mm). The space between the nozzle rows 22*a*, 22*b* is approximately 2.54 mm.

In the droplet discharge head 20, the piezoelectric elements 29 themselves bend and the vibrating plate 28 is deformed when a drive waveform as an electric signal is applied to the piezoelectric elements 29. The volume of the pressure generation chambers 25 thereby fluctuates, the resulting pump action applies pressure to the liquid material filled in the pressure generation chambers 25, and the liquid material can be discharged as droplets 30 from the nozzles 22.

The droplet discharge head 20 of the present embodiment has two so-called nozzle rows 22*a*, 22*b*, but is not limited to this arrangement alone and may also have only one row. The energy generation element for discharging the liquid material as droplets 30 from the nozzles 22 are not limited to the piezoelectric elements 29, and may also be heaters as electrothermal conversion elements, electrostatic actuators as electromechanical conversion elements, or the like.

Figure 3:
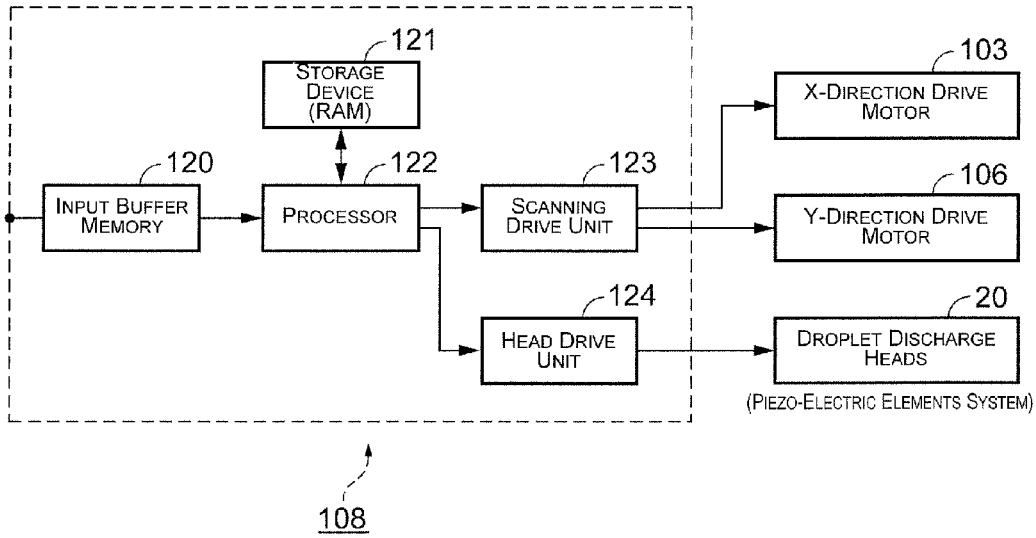
FIG. 3 is a block diagram showing the electrical configuration of the control device and of the components associated with the control device.

FIG. 3 is a block diagram showing the electrical configuration of the control device and of the components associated with the control device. The control device 108 comprises an input buffer memory 120 for receiving liquid material discharge data from an external information processing device, and a processor 122 for extracting the discharge data temporarily stored in the input buffer memory 120 to a storage device (RAM) 121 and sending a control signal to the associated components, as shown in FIG. 3 The control device 108 also comprises a scanning drive unit 123 for receiving the control signal from the processor 122 and sending a position control signal to the X-direction drive motor 103 and the Y-direction drive motor 106, and a head drive unit 124 for similarly receiving the control signal from the processor 122 and sending a drive voltage pulse (drive waveform) to the droplet discharge heads 20.

The discharge data received by the input buffer memory 120 includes data indicating the relative positions of the film formation areas on the workpiece W, data expressing how the droplets of the liquid material will be disposed as dots on the film formation areas, and data specifying which nozzles 22 of the nozzle rows 22*a*, 22*b* in the droplet discharge heads 20 will be driven (ON or OFF).

The processor 122 sends to the scanning drive unit 123 a control signal for positions relating to the film formation areas from among the discharge data stored in the RAM 121 used as a storage device. The scanning drive unit 123 receives this control signal and sends a position control signal to the X-direction drive motor 103 to move the droplet discharge heads 20 in the sub-scanning direction (X-direction). The scanning drive unit 123 also sends a position control signal to the Y-direction drive motor 106 to move the stage 104 holding the workpiece W in the main scanning direction (Y-direction). The droplet discharge heads 20 and the workpiece W are thereby moved correspondingly with respect to each other so that droplets 30 of the liquid material are discharged from the droplet discharge heads 20 onto the desired positions on the workpiece W.

Data expressing how the droplets 30 of the liquid material will be disposed as dots on the film formation areas, the data being taken from among the discharge data stored in the RAM 121, is converted to 4-bit discharge bitmap data for each nozzle 22 and sent to the head drive unit 124 by the processor 122. A latch (LAT) signal and a channel (CH) signal are also sent to the head drive unit 124. These signals are "timing detection signals" indicating when the drive voltage pulse (drive waveform) applied to the piezoelectric elements 29 of the droplet discharge heads 20 will be generated, on the basis of the data specifying which nozzles 22 of the nozzle rows 22*a*, 22*b* of the droplet discharge heads 20 will be driven (ON or OFF). The head drive unit 124 receives these control signals and sends an appropriate drive voltage pulse (drive waveform) to the droplet discharge heads 20, and droplets 30 of the liquid material are discharged from the nozzles 22.

The nozzle rows 22*a*, 22*b* both communicate with an independent common flow channel 27, as shown in FIG. 2. Therefore, wherein a drive waveform is applied simultaneously to the piezoelectric elements 29 of the 180 nozzles 22 constituting the nozzle rows 22*a*, 22*b*, electrical and mechanical crosstalk, whereby the droplet discharge amount (volume or mass) or discharge speed fluctuates, occurs readily between adjacent nozzles 22.

Therefore, in the present embodiment, the processor 122 sends a LAT signal and a CH signal to the head drive unit 124 so that droplets are not discharged simultaneously from adjacent nozzles 22 pertaining to the film formation areas. Specifically, the head drive unit 124 generates a drive voltage pulse (drive waveform) at specific cycles in accordance with the LAT signal. The processor 122 sends the CH signal to the head drive unit 124 so that chronologically different drive waveforms are applied to piezoelectric elements 29 corresponding to the aforementioned adjacent nozzles 22 in synchronization with the relative movement of the workpiece W and the droplet discharge heads 20. Furthermore, during main scanning, a control signal is sent to the head drive unit 124 so that the combination of drive waveforms applied to the piezoelectric elements 29 corresponding to the adjacent nozzles 22 is changed at least once. Electrical crosstalk is thereby avoided, and the occurrence of mechanical crosstalk is reduced.

COLOR FILTER

Figure 4:
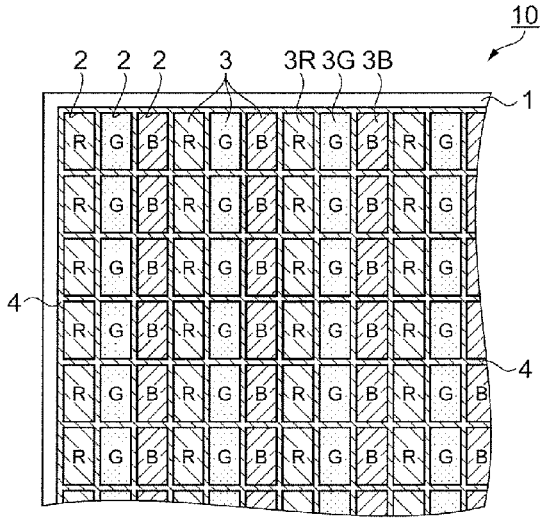
FIG. 4 is a plan view showing the color filter.

Next, the color filter according to the present embodiment will be described. FIG. 4 is a plan view showing the color filter.

A color filter 10 has walls 4 for partitioning a plurality of film formation areas 2 on the surface of a glass substrate 1 as a transparent substrate, as shown in FIG. 4. Colored layers 3 of three colors (R: red, G: green, B: blue) are formed on the film formation areas 2. The colored layers 3R, 3G, 3B are arranged so that colored layers 3 of the same color are arranged in a straight line. In other words, the color filter 10 comprises a streaked pattern of colored layers 3.

COLOR FILTER MANUFACTURING METHOD

Figure 5:
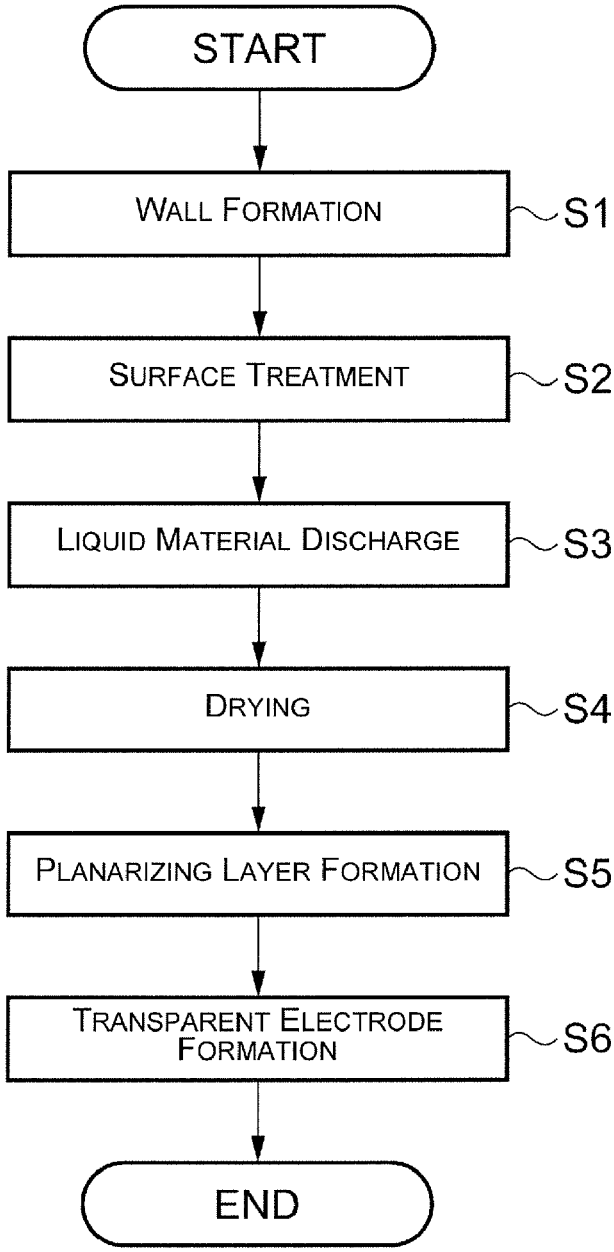
FIG. 5 is a flowchart showing the method for manufacturing the color filter.

Next, the method for manufacturing the color filter of the present embodiment will be described with reference to FIGS. 5 and 6. FIG. 5 is a flowchart showing the method for manufacturing the color filter, and FIGS. 6(*a*) through (*f*) are schematic cross-sectional views showing the method for manufacturing the color filter. The method for manufacturing the color filter 10 of the present embodiment uses the droplet discharge device 100 previously described, and the method for discharging a liquid material described hereinafter.

The method for manufacturing the color filter 10 of the present embodiment comprises a step (step S1) for forming walls 4 on the glass substrate 1, and a step (step S2) for treating the surface of the glass substrate 1 on which the walls 4 are formed. This method also comprises a step (step S3) for discharging liquid materials of three colors containing colored materials as functional materials onto the surface-treated glass substrate 1, and a step (step S4) for drying and fixing the discharged liquid materials in place to form the colored layers 3. This method further comprises a step (step S5) for forming a planarizing layer so as to cover the formed walls 4 and colored layers 3, and a step (step S6) for forming a transparent electrode on the planarizing layers.

Step S1 in FIG. 5 is a wall formation step. In step S1, first walls 4*a* are formed on the surface of the glass substrate 1 so as to partition the film formation areas 2, as shown in FIG. 6(*a*). The formation method involves using vacuum vapor deposition or sputtering to form a metal film made of Cr, Al, or the like; or a metal compound film on the surface of the glass substrate 1 so as to have a light-blocking effect. A photosensitive resin (photoresist) is then applied using photolithography to expose, develop, and etch the film formation areas 2 so that they open. A photosensitive wall-forming material is then applied in a thickness of approximately 2 μm using photolithography and is exposed and developed, thus forming second walls 4*b* over the first walls 4*a*. The walls 4 have a so-called two-layer bank structure composed of the first walls 4*a* and the second walls 4*b*. The walls 4 are not limited to this option alone, and may also have a single-layer structure containing only the second walls 4*b*, which are formed using a photosensitive wall-forming material having a light-blocking effect. The process then advances to step S2.

Step S2 in FIG. 5 is a surface treatment step. In step S2, the surface of the glass substrate 1 is subjected to a lyophilizing treatment so that the liquid material to be discharged in the subsequent liquid material discharging step will land on and spread out over the film formation areas 2. At least the peaks of the second walls 4*b* are subjected to a liquid-repellent treatment so that the discharged liquid material will be accommodated within the film formation areas 2 even if some of the liquid material lands on the second walls 4*b*.

For the surface treatment method, the glass substrate 1 on which the walls 4 are formed is subjected to a plasma treatment using $O_2$ as the treatment gas, and also to a plasma treatment using fluorine gas as the treatment gas. Specifically, the film formation areas 2 are subjected to a lyophilizing treatment, and the surfaces (including the wall surfaces) of the second walls 4*b* composed of a photosensitive resin are then subjected to a liquid-repellent treatment. If the very material forming the second walls 4*b* is liquid repellent, the liquid-repellent treatment can be omitted. The process then advances to step S3.

Step S3 in FIG. 5 is a liquid material discharging step. In step S3, the surface-treated glass substrate 1 is placed on the stage 104 of the droplet discharge device 100, as shown in FIG. 6(*b*). Droplets 30 are then discharged into the film formation areas 2 from the plurality of nozzles 22 of the droplet discharge heads 20 filed with liquid material containing the colored material, and the droplets are discharged in synchronization with the relative movement in the main scanning direction of the droplet discharge heads 20 and the stage 104 carrying the glass substrate 1. The total amount of liquid material discharged onto the film formation areas 2 is controlled by the processor 122 of the control device 108, which sends an appropriate control signal to the head drive unit 124 on the basis of discharge data in which the number of discharges and other factors are set in advance, so that a specific film thickness is obtained in the subsequent drying step (step S4). The specific method for discharging the liquid material will be described hereinafter. The process then advances to step S4.

Step S4 in FIG. 5 is the drying step. In step S4, the glass substrate 1 is heated by the heater 111 provided to the droplet discharge device 100, the solvent component is evaporated from the discharged liquid material to solidify the liquid material, and colored layers 3 composed of the colored material are formed, as shown in FIG. 6(*c*). The process then advances to step S5.

Step S5 in FIG. 5 is a planarizing layer formation step. In step S5, a planarizing layer 6 is formed so as to cover the colored layers 3 and the second walls 4*b*, as shown in FIG. 6(*e*). Possible examples of the formation method include coating with an acrylic resin by means of spin coating, roll coating, or the like, and then drying the coating. Another method that can be used is one in which a photosensitive acrylic resin is used for the coating, and the resin is then cured by exposure to ultraviolet light. The film thickness is approximately 100 nm. If the surface of the glass substrate 1 on which the colored layers 3 are formed is comparatively smooth, the planarizing layer formation step may be omitted. The process then advances to step S6.

Step S6 in FIG. 5 is a transparent electrode formation step. In step S6, a transparent electrode 7 composed of ITO (indium tin oxide) or the like is formed as a film over the planarizing layer 6, as shown in FIG. 6(*f*). Possible examples of the film formation method include sputtering or vapor deposition in a vacuum using ITO or another electroconductive material as the target. The film thickness is approximately 10 nm. The formed transparent electrode 7 is processed into a suitable and necessary shape (pattern) by an electro-optical device used by the color filter 10.

Figure 6:
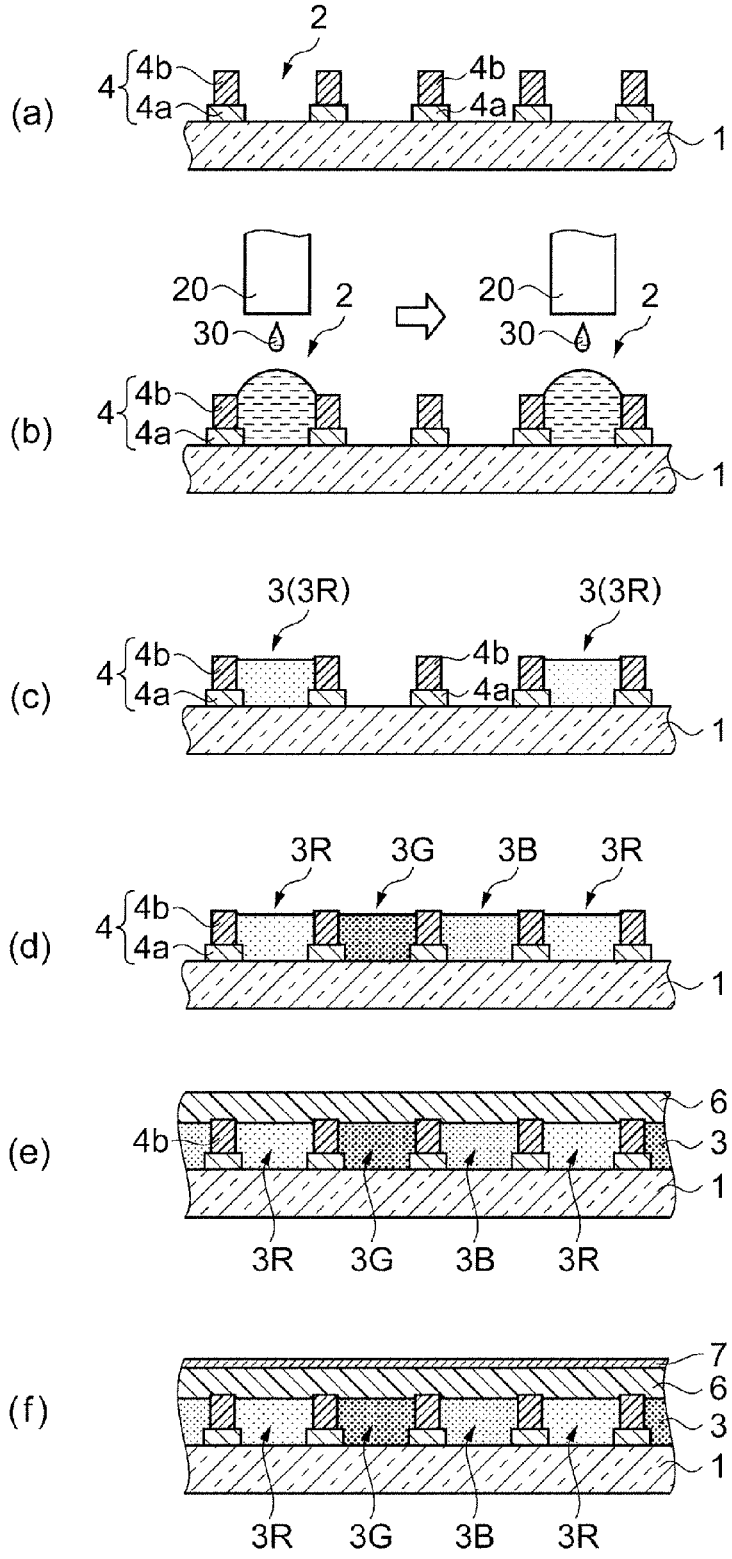
FIGS. 6(*a*) through 6(*f*) are schematic cross-sectional views showing the method for manufacturing the color filter.

In the present embodiment, first, the liquid material containing the R (red) colored material was discharged onto the film formation areas 2 and dried to form colored layers 3R, and then liquid materials containing different colored materials in the order G (green) and B (blue) were discharged in sequence and dried, thereby forming the three colored layers 3R, 3G, and 3B as shown in FIG. 6(*d*). The present invention is not limited to this option alone, and in the liquid material discharging step of step S3, for example, liquid materials of three colors containing different colored materials are loaded into different droplet discharge heads 20, the droplet discharge heads 20 are mounted on the head unit 101, and the liquid materials are discharged from the droplet discharge heads 20 onto the desired film formation areas 2. A method may then be used in which the glass substrate 1 is set in a reduced-pressure drying device that is capable of drying while the vapor pressure of the solvent is kept constant, and the glass substrate 1 is dried at reduced pressure.

METHOD FOR DISCHARING A LIQUID MATERIAL

The method for discharging a liquid material of the present embodiment will be described in detail on the basis of examples.

Figure 7:
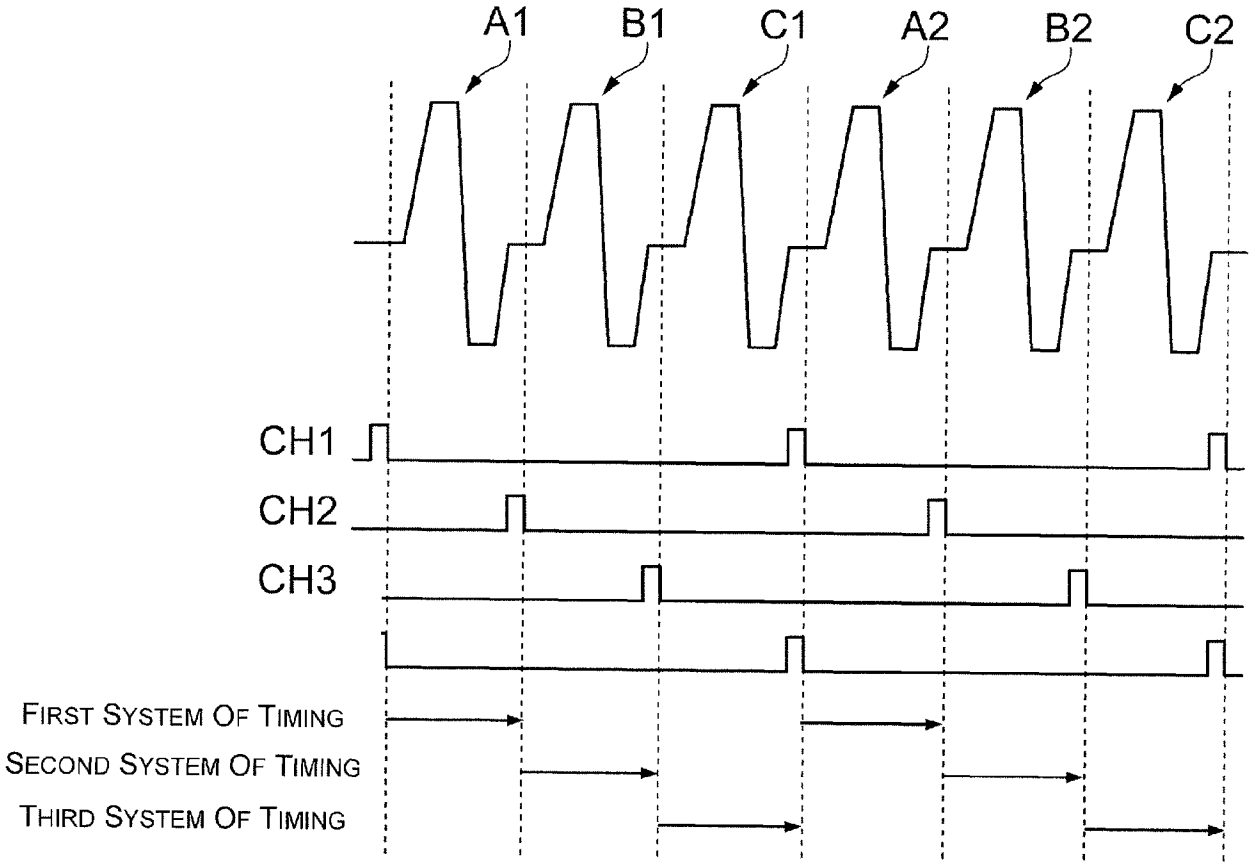
FIG. 7 is a timing chart showing the relationship between the drive waveform and the control signal.

First, the drive waveform according to the present embodiment will be described with reference to FIG. 7. FIG. 7 is a timing chart showing the relationship between the drive waveform and the control signal.

Some of drive waveforms A1, B1, C1, A2, B2, C2, etc. are selected and supplied to the piezoelectric elements 29 (see FIG. 2) arranged corresponding to the nozzles 22, in accordance with ON/OFF data (discharge data) for each nozzle 22 latched at the timing of the control signal LAT, as shown in FIG. 7. Droplets 30 are then discharged from the nozzles 22 at the timing with which the drive waveforms are supplied. The drive waveforms have the same shape and size, and these parameters are set so that a stipulated amount of droplets 30 is discharged as a result of the drive waveforms being supplied to the piezoelectric elements 29.

The drive waveforms are selected by control signals CH1 through CH3 for stipulating the supply timing of the drive waveforms. Specifically, the drive waveforms A1, A2, etc. having a first system of timing are selected by a control signal CH1, the drive waveforms B1, B2, etc. having a second system of timing are selected by a control signal CH2, and the drive waveforms C1, C2, etc. having a third system of timing are selected by a control signal CH3.

In the present embodiment, the supply timing systems for the drive waveforms (the relative order wherein the control signal LAT is used as a reference) individually correspond to the piezoelectric elements 29 corresponding to adjacent nozzles 22 associated with film formation areas 2, whereby the discharge timing is prevented from overlapping. At least electrical crosstalk is thereby suitably reduced, and discrepancies in discharge characteristics (discharged amounts, discharge rates, and the like) between nozzles due to crosstalk are relatively reduced. Since the system timing occurs in cycles, the discharge conditions are uniform with each discharge timing, and the amount of droplets 30 discharged can be stabilized with respect to the main scanning direction. Since three drive waveforms are generated within one cycle of the control signal LAT (within one latch), if three drive waveforms are applied to the same piezoelectric element 29 within one latch, the discharge timing can be changed and three droplets 30 can be discharged from the same nozzle 22. Furthermore, if three drive waveforms are applied to different piezoelectric elements 29 within one latch, droplets 30 can be discharged from three nozzles 22 at a different timing. Hereinafter, the application of a drive waveform to the piezoelectric element 29 of a nozzle 22 is referred to as the application of a drive waveform to a nozzle 22.

In the droplet discharge device 100, e.g., 200 mm/sec is the relative movement speed during main scanning between the droplet discharge heads 20 (the plurality of nozzles 22) and the glass substrate 1. The cycle of the control signal LAT, i.e., the drive frequency, is 20 kHz. Under such discharge conditions, the discharge resolution pertaining to one discharge during main scanning is approximately 10 μm when one of three drive waveforms is applied to the nozzle 22 being used, using one latch as a reference. In other words, when three drive waveforms are consecutively applied to the nozzle 22 being used, the discharge timing can be changed to discharge droplets in the main scanning direction at a minimum pitch of approximately 3.3 μm.

EXAMPLE 1

Figure 8:
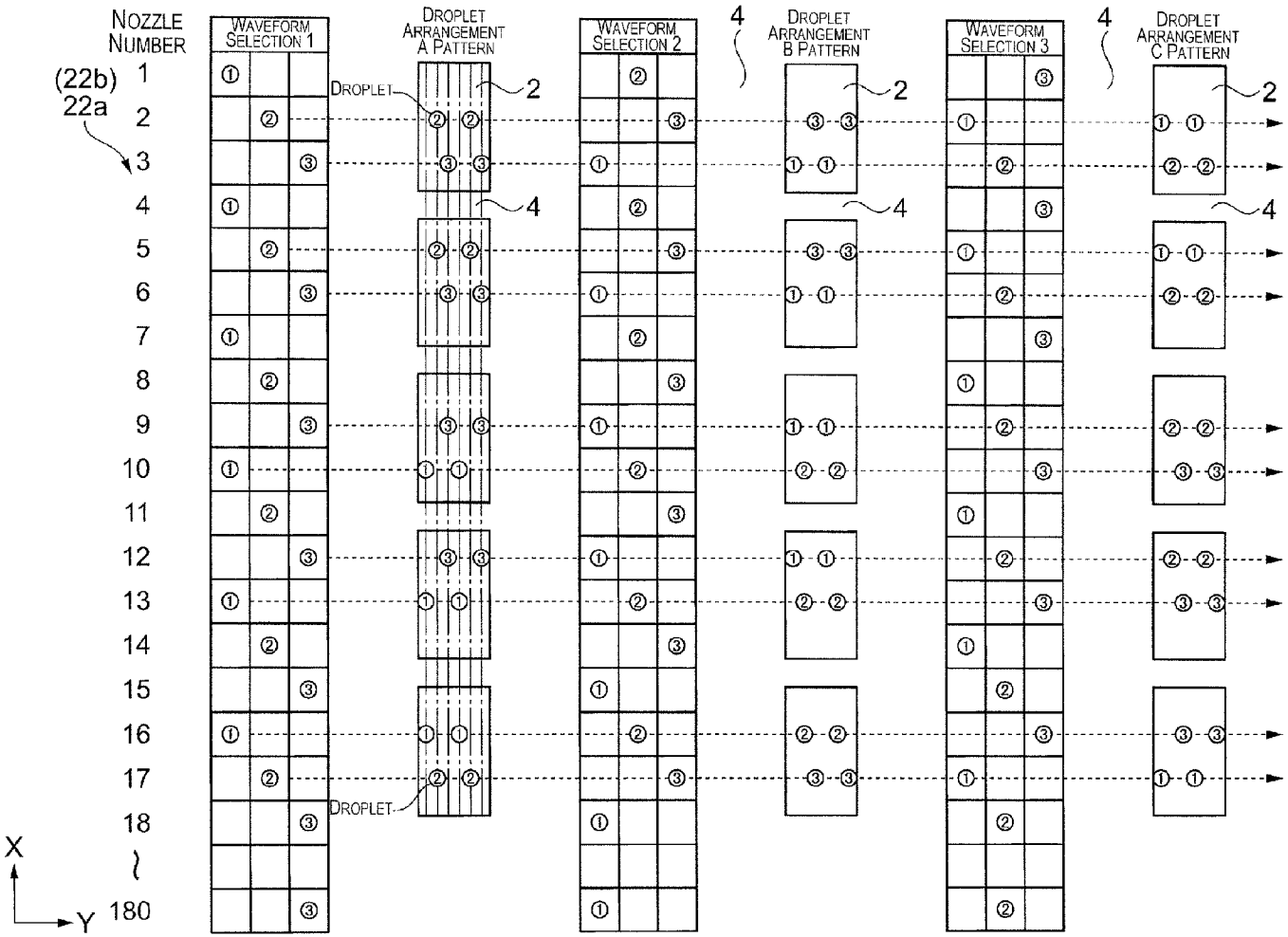
FIG. 8 is a schematic view showing the method for discharging a liquid material of Example 1.

FIG. 8 is a schematic view showing the method for discharging a liquid material of Example 1. Specifically, the diagram is a schematic view showing the selection of drive waveforms for the nozzle rows and the arrangement of droplets in the film formation areas.

Nozzle numbers are assigned to the 180 nozzles 22 of a nozzle row 22*a*, as shown in FIG. 8. A method for selecting the drive waveforms to be applied to the nozzles 22 is shown as an example. The numeral 1 in the waveform selection indicates the drive waveforms A1, A2, etc. generated with the first system of timing in FIG. 7. Similarly, the numeral 2 indicates the drive waveforms B1, B2, etc. generated with the second system of timing, and the numeral 3 indicates the drive waveforms C1, C2 generated with the third system of timing. The circled numerals 1 through 3 in the diagram are hereinafter referred to as waveform selection system numerals 1 through 3.

The size and arrangement pitch in the X and Y-directions of the film formation areas 2 is a matter of design, but in Example 1, with respect to the arrangement pitch of the nozzles 22 (approximately 140 μm), two nozzles 22 are associated with each of the film formation areas 2 during one main scan. In other words, the droplet discharge heads 20 and the glass substrate 1 are arranged correspondingly with respect to each other so that the nozzle row direction and the streaked direction of the color filter 10 shown in FIG. 4 coincide.

During main scanning, the nozzles 22 that pass the walls 4 partitioning the film formation areas 2 are not used, nor are nozzles 22 for which at least some of the discharged droplets are assumed to strike the walls 4. Specifically, these nozzles do not discharge. Two droplets are discharged in the main scanning direction from adjacent nozzles 22 (used nozzles) in each film formation area 2. The dot-dash lines drawn in the X-direction in the film formation areas 2 indicate the positions of droplets in the main scanning direction (Y-direction) when the first through third systems of drive waveforms are applied. FIG. 8 shows the combination of selected waveforms and the corresponding droplet arrangement patterns for film formation areas 2 onto which the same liquid material is discharged.

For the waveform selection 1, the system numerals 1 through 3 are repeatedly made to correspond to the nozzle numerals 1 through 180 in sequence. For the waveform selection 2, the sequence of the selection of system numerals 1 through 3 is offset by one from the waveform selection 1. For the waveform selection 3, the sequence of the selection of system numerals 1 through 3 is offset by one from the waveform selection 2.

The method for discharging a liquid material of Example 1 assumes the above-described waveform selection for the nozzle row 22*a*. Specifically, the drive waveforms are applied by selecting (combining) two systems from the drive waveforms of the first through third systems so that the drive waveforms are not applied with the same timing.

When the waveform selection 1 is applied, e.g., the drive waveforms B1, B2 of the second system are applied to the nozzle 22 of nozzle numeral 2. The drive waveforms C1, C2 of the third system are applied to the adjacent nozzle 22 of nozzle numeral 3. The droplets discharged from the nozzles 22 of nozzle numerals 2 and 3 onto the film formation area 2 are arranged such that four droplets are out of alignment with regard to each other in the main scanning direction, as shown in the A pattern.

When the waveform selection 1 is applied and droplets are repeatedly discharged onto film formation areas 2 arranged in the main scanning direction, drive waveforms of the same system will always be applied to the used nozzle 22. Although at least electrical crosstalk between adjacent nozzles 22 can be avoided, there is a danger of disparities in the amount of droplets discharged due to nonuniformity in discharge characteristics between nozzles 22. When droplets having disparities in their discharged amounts are consecutively discharged in the main scanning direction from adjacent nozzles 22, they appear as streaked discharge irregularities.

To prevent such discharge irregularities in the method for discharging a liquid material of Example 1, the system for the drive waveforms applied to adjacent nozzles 22 is changed for each film formation area 2 during main scanning. Specifically, since any of the waveform selections 1, 2, or 3 are applied for each film formation area 2, the arrangement of droplets will be any of the patterns A, B, or C. The patterns A through C may be repeated in sequence, or they may be randomized. The patterns are preferably applied so that the same droplet arrangement pattern does not continue. Specifically, disparities in the amount of droplets discharged due to nonuniformity in discharge characteristics between nozzles 22 are dispersed in the main scanning direction.

EXAMPLE 2

Figure 9:
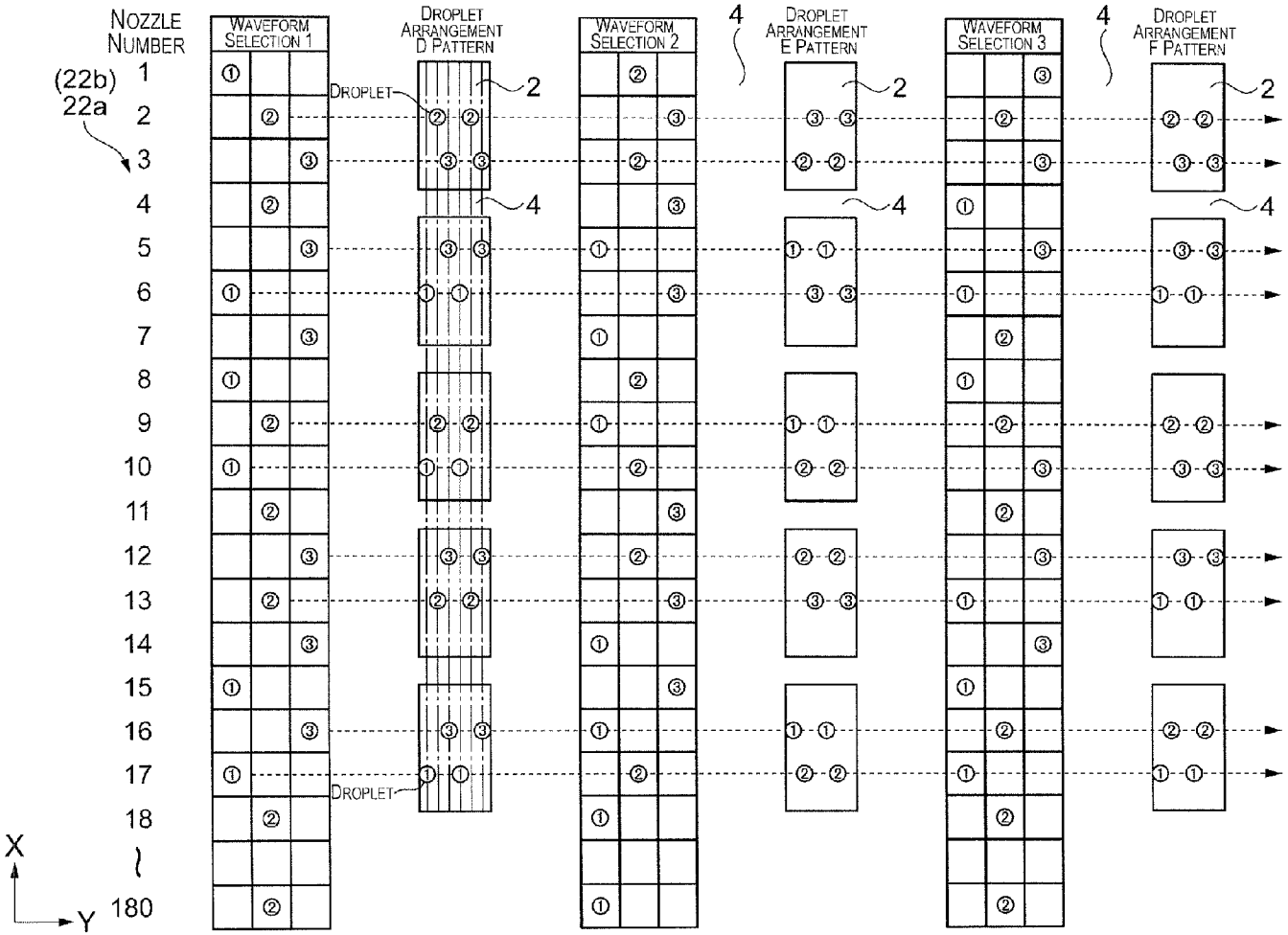
FIG. 9 is a schematic view showing the method for discharging a liquid material of Example 2.

Next, the method for discharging a liquid material of Example 2 will be described, focusing on the differences from Example 1. FIG. 9 is a schematic view showing the method for discharging a liquid material of Example 2.

In the method for discharging a liquid material of Example 2, the allocation of drive waveforms of the first through third systems to the nozzle numerals in waveform selection 1 is different from that of Example 1, as shown in FIG. 9. Specifically, to state the sequence of drive waveform systems in the nozzle row 22*a*, the system numerals are 1, 2, 3, 2, 3, 1, 3, 1, 2 . . . (thereinafter repeating). As a result of this waveform selection, drive waveforms of the same system are not applied to adjacent nozzles 22. The number of nozzles 22 to which drive waveforms of the same system are applied (the number of nozzles 22 used) is set so as to be substantially equal with each system. The manner in which the drive waveforms weaken during droplet discharge is thereby made substantially uniform, thus preventing disparities in the amount of droplets discharged due to weakening of the drive waveforms. The other discharge conditions (waveform selection method) are similar to those of Example 1.

Specifically, since any of the waveform selections 1, 2, or 3 are applied for each film formation area 2, the arrangement of droplets will be any of the patterns D, E, or F.

EXAMPLE 3

Figure 10:
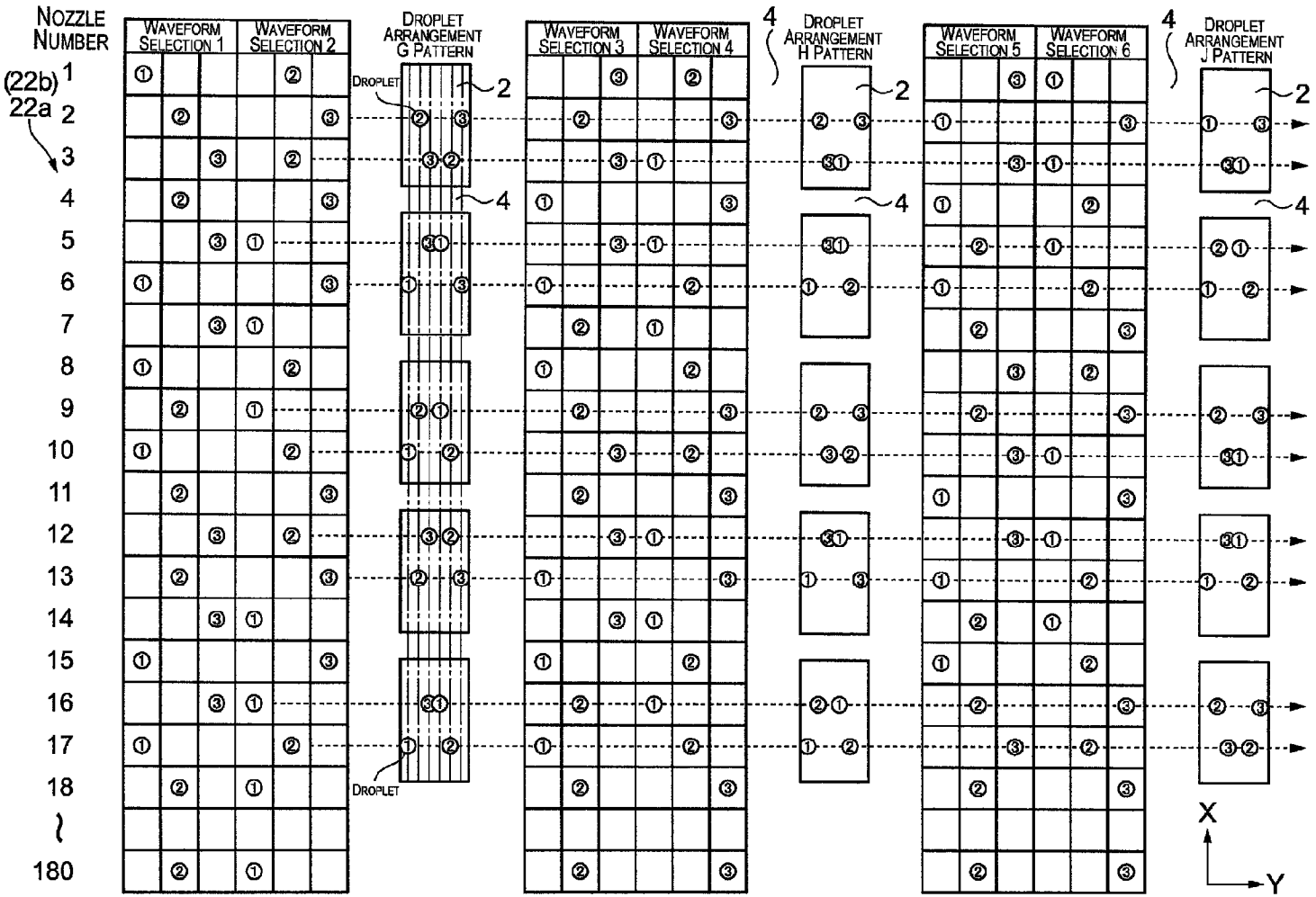
FIG. 10 is a schematic view showing the method for discharging a liquid material of Example 3.

Next, the method for discharging a liquid material of Example 3 will be described, focusing on the differences from Example 2. FIG. 10 is a schematic view showing the method for discharging a liquid material of Example 3.

In the method for discharging a liquid material of Example 3, the manner of allocating the drive waveforms of the first through third systems to the nozzle numerals in the waveform selection 1 is the same as in Example 2, but the waveform selections 1 through 6 are switched in sequence for each droplet discharged from the same nozzle 22, as shown in FIG. 10. In the waveform selections 2 through 6, the selections of the drive waveforms of the first through third systems in the waveform selection 1 are sequentially misaligned by one nozzle each. Consequently, the droplet arrangement is any of the patterns G, H, or J. The system of drive waveforms thereby changes with each droplet discharge in the adjacent nozzles 22 associated with a film formation area 2. In other words, a different drive waveform is applied for each droplet discharge in the same nozzle 22. Therefore, disparities in the discharged amount of droplets arranged on each film formation area 2 are dispersed even more.

EXAMPLE 4

Figure 11:
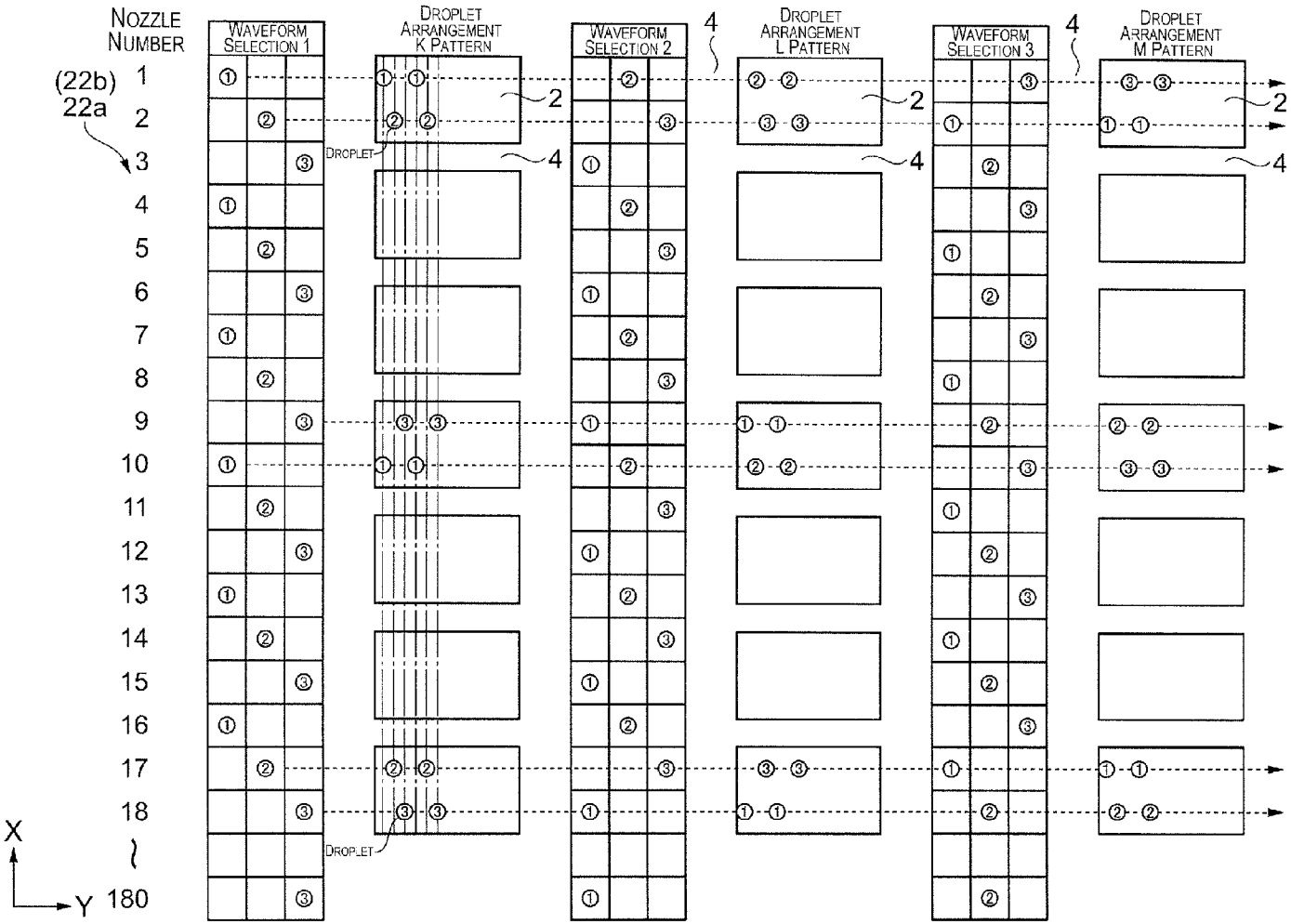
FIG. 11 is a schematic view showing the method for discharging a liquid material of Example 4.

Next, the method for discharging a liquid material of Example 4 will be described, focusing on the differences from Example 1. FIG. 11 is a schematic view showing the method for discharging a liquid material of Example 4.

The method for discharging a liquid material of Example 4 has a different relative arrangement between the nozzle row 22*a* and the film formation areas 2 in comparison to Example 1, as shown in FIG. 11. In Example 4, the film formation areas 2 onto which the same liquid material is discharged are arranged continuously in the main scanning direction (Y-direction). Film formation areas 2 onto which different liquid materials are discharged are arranged at specific intervals in the sub-scanning direction (X-direction). Therefore, the number of nozzles 22 used by one discharge is smaller in comparison with Example 1. Furthermore, the number of nozzles 22 used for each drive waveform is set so as to be substantially the same, similar to Example 2. Consequently, the electrical load caused by discharge with each drive waveform is even smaller. Similar to Example 1, the combination of drive waveforms (waveform selection) applied to the nozzles 22 used differs for each film formation area 2 on which the same liquid material is discharged. Therefore, the arrangement of droplets will be any of the patterns K, L, or M, and disparities in the discharged amount of droplets due to weakening of the drive waveforms are further prevented. In the case of Example 4, since droplets are disposed in the longitudinal direction of the rectangular film formation areas 2 during main scanning, the number of droplets discharged (number of discharges) from the nozzles 22 used for each film formation area 2 may be further increased, rather than being merely two.

In Examples 1 through 4, the descriptions above focused on only the nozzle row 22*a* for the sake of convenience, but the same discharges are in actuality performed from the nozzle row 22*b* (see FIG. 2) at positions that complement the pitch of the nozzle row 22*a*.

The total discharged amount (necessary amount) of liquid material applied to the film formation areas 2 is determined according to the required film characteristics (in the case of a color filter, the transmissivity, the chromaticity, the saturation, and other such optical characteristics), with regard to the size (surface area) of the film formation areas 2 and the solute concentration of the liquid material. Therefore, in cases in which the aforementioned total discharged amount is applied to the film formation areas 2 by a plurality of main scans, it is preferable that the arrangement pattern of the droplets be different for each main scanning. Specifically, the combination of waveform selections is preferably different with each main scanning. Disparities in the discharged amount of droplets can thereby be dispersed even more.

Furthermore, if the plurality of nozzles 22 (droplet discharge heads 20) is sub-scanned and main scanning is then performed with different nozzles 22 associated with the film formation areas 2, it is possible to further disperse disparities in the discharged amount of droplets resulting from nonuniformity in discharge characteristics between nozzles.

Thus, the combination of drive waveforms of different discharge timings applied to adjacent nozzles 22 associated with the film formation areas 2 is changed at least once with each main scanning, which yields a suitable operation and effects.

In Examples 1 through 4, it is comparatively easy to sequentially shift the selection of the first through third systems of drive waveforms from the waveform selection 1 by one nozzle at a time in the direction of nozzle rows and to set another waveform selection, because the droplet arrangement pattern that applies the waveform selection 1 can be followed when the droplet arrangement pattern is converted to discharge data.

LIQUID CRYSTAL DESPLAY DEVICE

Figure 12:
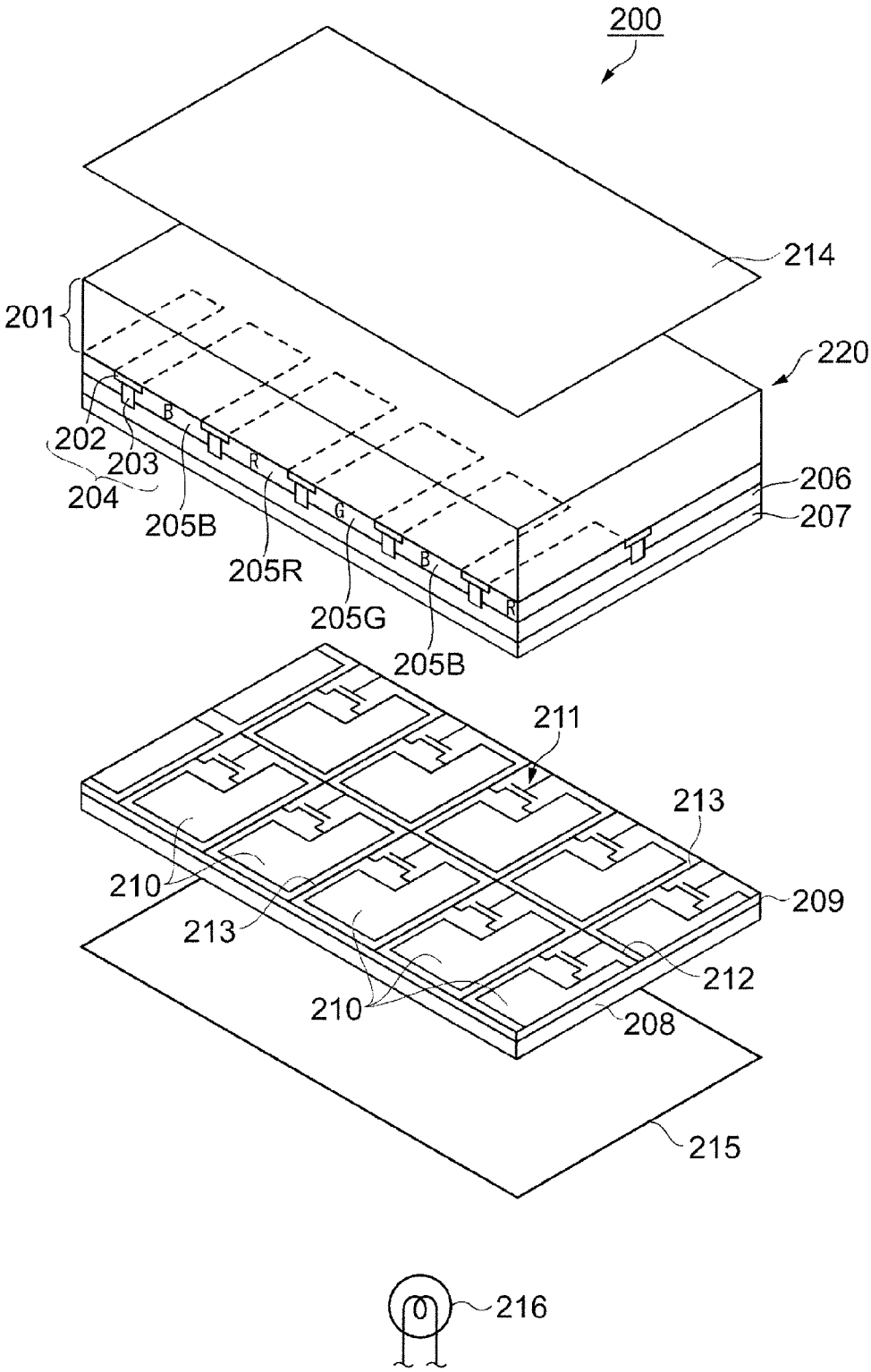
FIG. 12 is a schematic exploded perspective view showing the configuration of the liquid crystal display device.

The following is a simple description of a liquid crystal display device having the color filter. FIG. 12 is a schematic exploded perspective view showing the configuration of the liquid crystal display device.

A liquid crystal display device 200 includes a TFT (thin film transistor) transmissive liquid crystal display panel 220, and an illuminating device 216 for illuminating the liquid crystal display panel 220, as shown in FIG. 12. The liquid crystal display panel 220 includes an opposing substrate 201 having a color filter, an element substrate 208 having TFT elements 211 in which one of three terminals is connected to pixel electrodes 210, and a liquid crystal (not shown) sandwiched by the two substrates 201, 208. An upper polarization plate 214 and a lower polarization plate 215 for deflecting transmitted light are provided on the surfaces of the two substrates 201, 208, which are located on the external surfaces of the liquid crystal display panel 220.

The opposing substrate 201 is composed of transparent glass or another such material, and has color filters 205R, 205G, 205B for the three colors red (R), green (G), and blue (B) formed on a plurality of film formation areas partitioned into a matrix formation by walls 204 on the surfaces sandwiching the liquid crystal. The walls 204 are configured from bottom layer banks 202 referred to as a black matrix, which are composed of Cr another such light-blocking metal or an oxide film thereof; and top layer banks 203 composed of an organic compound and formed on top of the bottom layer banks 202 (upside down in the drawing). Also included are an overcoat layer (OC layer) 206 as a planarizing layer for covering the walls 204 and the color filters 205R, 205G, 205B, and an opposing electrode 207 composed of ITO (indium tin oxide) or another such transparent electroconductive film formed so as to cover the OC layer 206. The opposing substrate 201 is manufactured using the method for manufacturing the color filter 10 of the embodiment described above (any one of Examples 1 through 4 is applied).

The element substrate 208 is similarly composed of transparent glass or another such material, and has pixel electrodes 210 formed into a matrix formation via an insulating film 209 on the surfaces sandwiching the liquid crystal, and a plurality of TFT elements 211 formed corresponding to the pixel electrodes 210. Of the three terminals of each TFT element 211, the other two terminals not connected to a pixel electrode 210 are connected to a scanning wire 212 and a data wire 213 arranged in a lattice formation so as to enclose the pixel electrodes 210 while being insulated from each other.

The illuminating device 216 may be any type of device that uses, e.g., an LED, an EL, a cold-cathode tube, or the like as a light source; and that includes a light-guiding plate, a diffuser, a reflective plate, or another such configuration that can emit light from these light sources toward the liquid crystal display panel 220.

The liquid crystal display device 200 has a high display quality with few color irregularities and other such display inconveniences, because the device includes the opposing substrate 201 having the color filters 205R, 205G, 205B, which are manufactured using the method for manufacturing the color filter 10 of the embodiment described above.

The liquid crystal display panel 220 is not limited to having TFT elements 211 as active elements, and may also have TFD (thin film diode) elements. Furthermore, as long as the liquid crystal display panel 220 has a color filter on at least one substrate, the panel may be a passive liquid crystal display device in which electrodes constituting pixels are disposed so as to intersect with each other. The upper and lower polarization plates 214, 215 may also be combined with a phase difference film or another such optically functional film used for the purpose of improving visual angle dependency or other such purposes.

According to the first embodiment, the following effects are achieved.

(1) In the method for discharging a liquid material of Example 1, since the applied waveform selection is switched for each film formation area 2 arranged in the main scanning direction, drive waveforms for different discharge timings are applied to adjacent nozzles 22 associated with the film formation areas 2, and electrical crosstalk at least is reduced. Disparities in droplet discharge amounts resulting from nonuniformity in the discharge characteristics of the plurality of nozzles 22 can be prevented, and streaked discharge irregularities in the main scanning direction can be reduced.

(2) In the method for discharging a liquid material of Example 2, the drive waveforms of the first through third systems having a different timing are allocated among of the nozzles 22 of the nozzle row 22*a;* therefore, the number of nozzles 22 used is set to be substantially the same for the drive waveform of each system. Therefore, in addition to the effects of Example 1, the weakening of the drive waveforms can be made substantially uniform, and disparities in the discharged amounts of droplets can be prevented.

(3) In the method for discharging a liquid material of Example 3, since the applied waveform selection is changed with each droplet discharge in every film formation area 2 arranged in the main scanning direction, disparities in the amount of droplets discharged can be prevented in each film formation area 2, and streaked discharge irregularities in the main scanning direction can be further reduced, in addition to the effects of Example 2.

(4) In the method for discharging a liquid material of Example 4, for each film formation area 2 onto which the same liquid material is discharged, and which is arranged consecutively in the main scanning direction, a different waveform selection is applied to discharge droplets from adjacent nozzles 22 associated with the film formation areas 2. As in Example 2, the number of nozzles 22 used is set to be substantially the same with each drive waveform, and the number of nozzles 22 to which drive waveforms are applied simultaneously is smaller than in Example 1. Consequently, in addition to the effects of Example 1, the electrical load pertaining to droplet discharge is even smaller, and disparities in the droplet discharge amounts due to weakening of the drive waveforms can be further prevented.

(5) In the method for manufacturing the color filter 10 of the first embodiment described above, the method for discharging a liquid material described above is used to discharge liquid materials of three colors onto the desired film formation areas 2 and to dry the liquid materials, thereby forming colored layers 3R, 3G, 3B. Therefore, streaked discharge irregularities in the main scanning direction can be reduced, and color filters 10 can be manufactured at a better yield rate.

SECOND EMBODIMENT

The following is a description of an organic EL display device containing the organic EL (electroluminescence) element according to the present embodiment, and also of a method for manufacturing the organic EL element.

ORGANIC EL DISPLAY DEVICE

Figure 13:
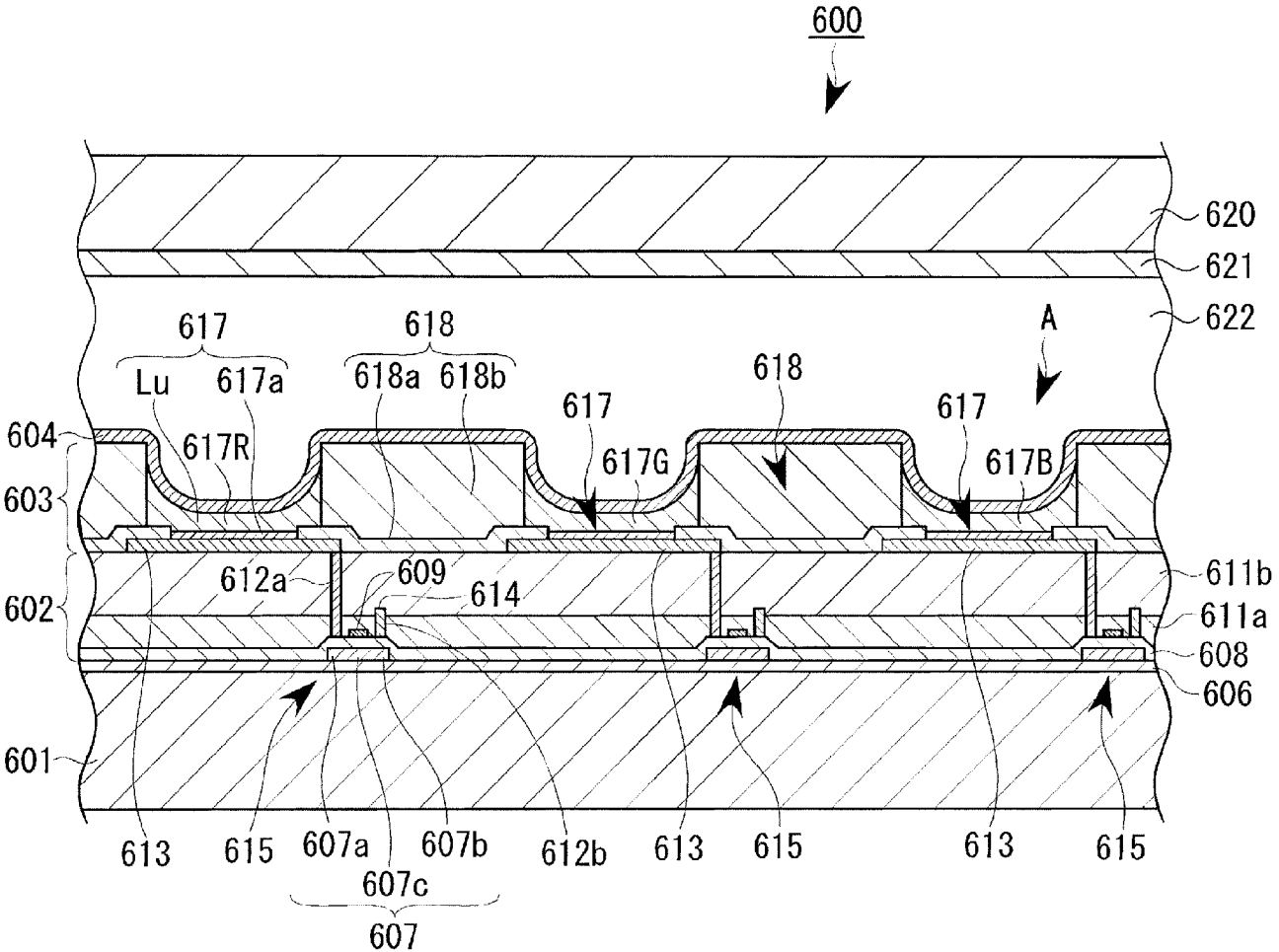
FIG. 13 is a schematic cross-sectional view showing the organic EL display device.

FIG. 13 is a schematic cross-sectional view showing an organic EL display device. An organic EL display device 600 includes an element substrate 601 having a light-emitting element part 603 as an organic EL element, and a sealing substrate 620 sealed in with a space 622 between the sealing substrate 620 and the element substrate 601, as shown in FIG. 13. The element substrate 601 includes a circuit element part 602 on top of the substrate. The light-emitting element part 603 is formed superposed over the circuit element part 602, and is driven by the circuit element part 602. The light-emitting element part 603 has light-emitting layers 617R, 617G, 617B of three colors forming a streaked pattern in light-emitting layer formation areas A as film formation areas. In the element substrate 601, three light-emitting layer formation areas A corresponding to the light-emitting layers 617R, 617G, 617B of three colors form one picture element, and this picture element is arranged in a matrix formation on the circuit element part 602 of the element substrate 601. In the organic EL display device 600, light from the light-emitting element part 603 is emitted toward the element substrate 601.

The sealing substrate 620 is composed of glass or metal and is therefore bonded to the element substrate 601 via a sealing resin, and a getter agent 621 is affixed to the surface of the sealed inner side. The getter agent 621 absorbs water or oxygen that has permeated into the space 622 between the element substrate 601 and the sealing substrate 620, and prevents the light-emitting element part 603 from being degraded by the permeated water or oxygen. This getter agent 621 may also be omitted.

The element substrate 601 has a plurality of light-emitting layer formation areas A on top of the circuit element part 602, and includes walls 618 for partitioning the light-emitting layer formation areas A, electrodes 613 formed in the light-emitting layer formation areas A, and hole injection/transport layers 617*a* stacked on the electrodes 613. Also included is the light-emitting element part 603, which has the light-emitting layers 617R, 617G, 617B formed by providing three liquid materials containing a light-emitting layer formation material into the plurality of light-emitting layer formation areas A. The walls 618 are composed of bottom layer banks 618*a* and of upper layer banks 618*b* for substantially partitioning the light-emitting layer formation areas A, wherein the bottom layer banks 618*a* are provided so as to project into the inner sides of the light-emitting layer formation areas A and are formed from $SiO_2$ or another such inorganic insulating material in order to prevent the electrodes 613 and the light-emitting layers 617R, 617G, 617B from coming into direct contact and electrically short-circuiting.

The element substrate 601 is composed of, e.g., glass or another such transparent substrate. A base protective film 606 composed of a silicon oxide film is formed on the element substrate 601, and island-shaped semiconductor films 607 composed of polycrystalline silicon are formed on this foundation protective film 606. Source areas 607*a* and drain areas 607*b* are formed by high-concentration P ion implantation in these semiconductor films 607. The portions in which P ions are not introduced are channel areas 607*c*. Furthermore, a transparent gate insulating film 608 is formed for covering the base protective film 606 and the semiconductor films 607, gate electrodes 609 composed of Al, Mo, Ta, Ti, W, or the like are formed on the gate insulating film 608, and a transparent first interlayer insulating film 611*a* and a second interlayer insulating film 611*b* are formed on top of the gate electrodes 609 and the gate insulating film 608. The gate electrodes 609 are provided in positions corresponding to the channel areas 607*c* of the semiconductor films 607. Contact holes 612*a*, 612*b* are also formed through the first interlayer insulating film 611*a* and the second interlayer insulating film 611*b*, and the contact holes 612*a*, 612*b* are connected to the source areas 607*a* and drain areas 607*b* of the semiconductor films 607, respectively. The transparent electrodes 613 composed of ITO (indium tin oxide) are patterned and disposed in a specific shape on the second interlayer insulating film 611*b*, and the contact holes 612*a* are connected to these electrodes 613. The other contact holes 612*b* are connected to a power source line 614. Thus, driving thin film transistors 615 connected to the electrodes 613 are formed in the circuit element part 602. Thin film transistors for retention volume and for switching are also formed in the circuit element part 602, but these are not shown in FIG. 13.

The light-emitting element part 603 includes the electrodes 613 as anodes; the hole injection/transport layers 617*a* and the light-emitting layers 617R, 617G, 617B (collectively referred to as the light-emitting layers Lu) stacked in the stated order on the electrodes 613; and a cathode 604 stacked thereon so as to cover the upper layer banks 618*b* and the light-emitting layers Lu. The hole injection/transport layers 617*a* and the light-emitting layers Lu constitute functional layers 617 whereby the emitted light is excited. If the cathode 604, the sealing substrate 620, and the getter agent 621 are configured from transparent materials, the emitted light can exit through the sealing substrate 620.

The organic EL display device 600 has a scanning line (not shown) connected to the gate electrodes 609 and a signal line (not shown) connected to the source areas 607*a*, and when the switching thin film transistors (not shown) are turned on by a scanning signal sent to the scanning line, the electric potential of the signal line at the time is retained in the retention volume, and the on/off state of the driving thin film transistors 615 is determined according to the state of the retention volume. An electric current flows from the power source line 614 to the electrodes 613 via the channel areas 607*c* of the driving thin film transistors 615, and the electric current further flows to the cathode 604 via the hole injection/transport layers 617*a* and the light-emitting layers Lu. The light-emitting layers Lu emit light in accordance with the amount of the current flowing through these components. The organic EL display device 600 can display the desired letters, images, and the like using the light-emitting mechanism of this type of light-emitting element part 603. The organic EL display device 600 has reduced light emission irregularities, brightness irregularities, and other such display inconveniences caused by nonuniformity in the discharge characteristics of the nozzle row 22*a* (22*b*), and has high display quality, because the light-emitting layers Lu are formed using the method for discharging a liquid material of the first embodiment.

METHOD FOR MANUFACTORING ORGANIC EL ELEMENT

Figure 14:
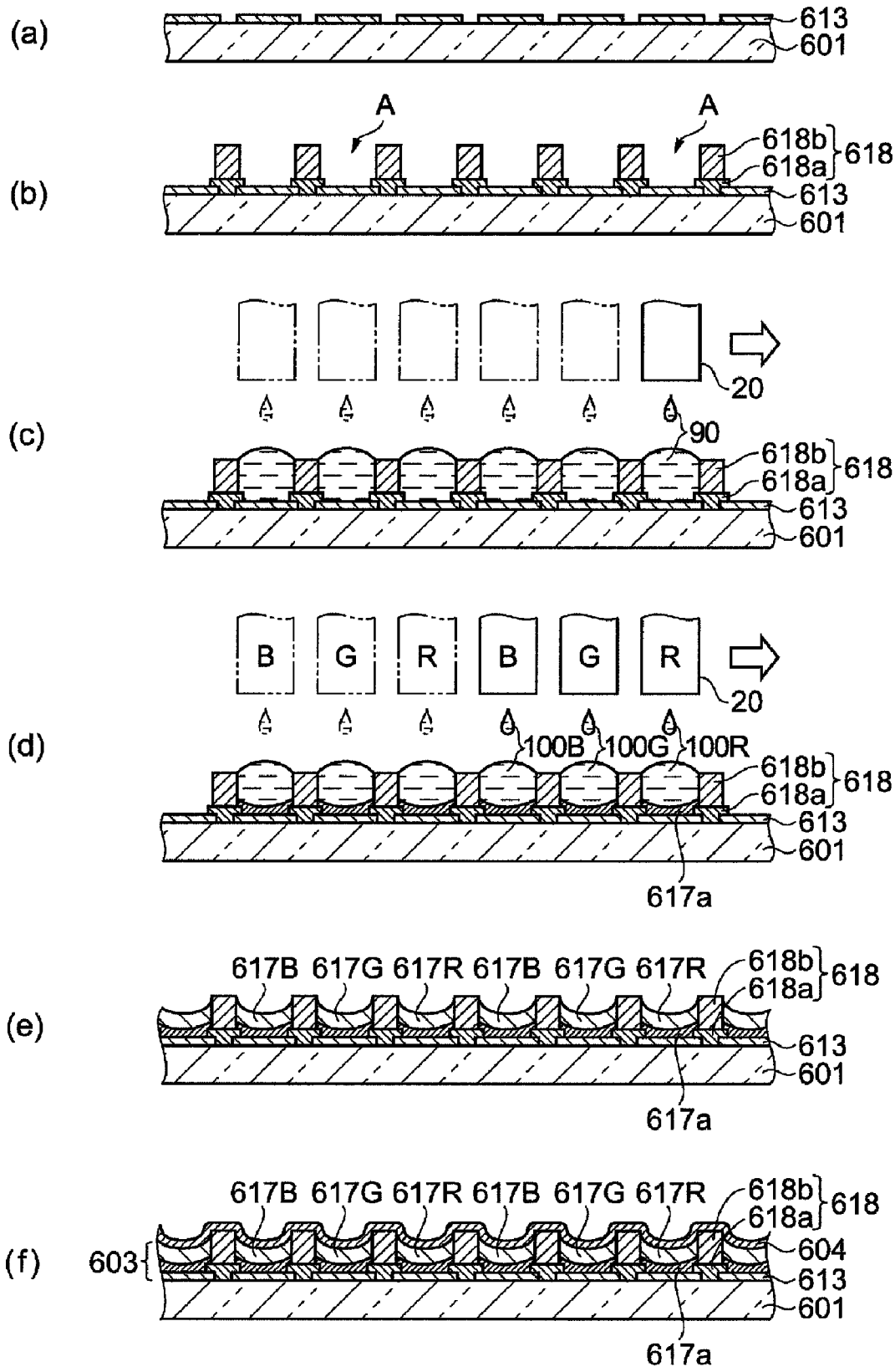
FIGS. 14(*a*) through 14(*f*) are schematic cross-sectional views showing the method for manufacturing the organic EL element.

Next, the method for manufacturing the light-emitting element part 603 as the organic EL element of the present embodiment will be described with reference to FIG. 14. FIGS. 14(*a*) through (*f*) are schematic cross-sectional views showing the method for manufacturing the organic EL element. In FIGS. 14(*a*) through (*f*), the circuit element part 602 formed on the element substrate 601 is not shown.

The method for manufacturing the light-emitting element part 603 of the present embodiment includes a step of forming the electrodes 613 at positions corresponding to the plurality of light-emitting layer formation areas A on the element substrate 601, and a wall formation step in which the bottom layer banks 618*a* are formed so as to partially overlap the electrodes 613, and the upper layer banks 618*b* are furthermore formed on the bottom layer banks 618*a* so as to substantially partition the light-emitting layer formation areas A. Also included are a step for performing a surface treatment on the light-emitting layer formation areas A partitioned by the upper layer banks 618*b*, a step for providing a liquid material containing a hole injection/transport layer formation material into the surface-treated light-emitting layer formation areas A to discharge and render hole injection/transport layers 617*a*, and a step for drying the discharged liquid material to form the hole injection/transport layers 617*a* as films. Also included are a step for performing a surface treatment on the light-emitting layer formation areas A in which the hole injection/transport layers 617*a* are formed, a discharging step for discharging three liquid materials containing a light-emitting layer formation material into the surface-treated light-emitting layer formation areas A, and a step for drying the three discharged liquid materials to form the light-emitting layers Lu as films. Furthermore, a step is included for forming the cathode 604 so as to cover the upper layer banks 618*b* and the light-emitting layers Lu. The liquid materials are provided to the light-emitting layer formation areas A by using the method for discharging a liquid material of the first embodiment described above.

In the electrode (anode) formation step, the electrodes 613 are formed at positions corresponding to the light-emitting layer formation areas A on the element substrate 601 where the circuit element part 602 is already formed, as shown in FIG. 14(*a*). For this formation method, e.g., a transparent electrode film is formed on the surface of the element substrate 601 by sputtering or vapor deposition in a vacuum, using ITO or another such transparent electrode material. One possible method thereafter is to use photolithography to perform etching, leaving only the necessary portions to form the electrodes 613. The process then advances to the wall formation step.

In the wall formation step, the bottom layer banks 618*a* are formed so as to cover some of the plurality of electrodes 613 of the element substrate 601, as shown in FIG. 14(*b*). Insulating $SiO_2$ (silicon dioxide), which is an inorganic material, is used as the material for the bottom layer banks 618*a*. One example of the method for forming the bottom layer banks 618*a* is to use a resist or the like to mask the surfaces of the electrodes 613 in accordance with the light-emitting layers Lu that will be formed afterward. A method is then exemplified in which the masked element substrate 601 is placed in a vacuum device, and sputtering or vacuum vapor deposition is performed using $SiO_2$ as the target or starter material, thereby forming the bottom layer banks 618*a*. The mask of the resist or the like is afterward peeled off. Since the bottom layer banks 618*a* are formed from $SiO_2$, they are sufficiently transparent if their film thickness is 200 nm or less, and the emission of light is not inhibited even if the hole injection/transport layers 617*a* and the light-emitting layers Lu are stacked.

Next, the upper layer banks 618*b* are formed on top of the bottom layer banks 618*a* so as to substantially partition the light-emitting layer formation areas A. The material of the upper layer banks 618*b* is preferably durable against the solvents of the three liquid materials 100R, 100G, 100B containing the hereinafter-described light-emitting layer formation material, and is preferably an organic material such as an acrylic resin, an epoxy resin, a photosensitive polyimide, or the like that can be made liquid-repellent by a plasma treatment that uses a fluorine-based gas as the treatment gas. An example of the method for forming the upper layer banks 618*b* is to use roll-coating or spin-coating to apply the photosensitive organic material described above to the surface of the element substrate 601 on which the bottom layer banks 618*a* are formed, and to then dry the material to form a photosensitive resin layer having a thickness of approximately 2 μm. A method is then exemplified in which a mask provided with openings of a size corresponding to the light-emitting layer formation areas A is made to face the element substrate 601 at a specific position and is exposed to light and developed, thereby forming the upper layer banks 618*b*. The walls 618 having the bottom layer banks 618*a* and upper layer banks 618*b* are thereby formed. The process then advances to the surface treatment step.

In the step for surface-treating the light-emitting layer formation areas A, the element substrate 601 on which the walls 618 are formed is first subjected to a plasma treatment using $O_2$ gas as the treatment gas. The surfaces of the electrodes 613, the protruding parts of the bottom layer banks 618*a*, and the surfaces of the upper layer banks 618*b* (including the wall surfaces) are thereby activated and subjected to a lyophilizing treatment. Next, a plasma treatment is performed using $CF_4$ or another such fluorine-based gas as the treatment gas. The fluorine-based gas thereby reacts with and performs a liquid-repellent treatment on only the surfaces of the upper layer banks 618*b* composed of the photosensitive resin, which is an organic material. The process then advances to the hole infusion/transport layer formation step.

In the hole infusion/transport layer formation step, a liquid material 90 containing a hole infusion/transport layer formation material is provided in the light-emitting layer formation areas A, as shown in FIG. 14(*c*). The droplet discharge device 100 in FIG. 1 is used as the method for providing the liquid material 90. The liquid material 90 discharged from the droplet discharge heads 20 strikes the electrodes 613 of the element substrate 601 as droplets and spreads over the electrodes. The needed amount of the liquid material 90 is discharged as droplets in accordance with the surface areas of the light-emitting layer formation areas A. The process then advances to the drying/film formation step.

In the drying/film formation step, the element substrate 601 is heated by, e.g., the heater 111 (lamp annealing or the like) provided to the droplet discharge device 100, whereby the solvent components in the liquid material 90 are dried and removed, and the hole injection/transport layers 617*a* (see FIG. 14(*d*)) are formed in the areas partitioned by the bottom layer banks 618*a* of the electrodes 613. In the present embodiment, PEDOT (polyethylene dioxy thiophene) is used as the hole infusion/transport layer formation material. In this case, hole injection/transport layers 617*a* composed of the same material are formed in the light-emitting layer formation areas A, but the material of the hole injection/transport layers 617*a* may be varied with each light-emitting layer formation area A in accordance with the light-emitting layers Lu formed hereinafter. The process then advances to the next surface treatment step.

In the next surface treatment step, in cases in which the hole infusion/transport layer formation material described above is used to form the hole injection/transport layers 617*a*, the surfaces thereof are liquid-repellent against the three liquid materials 100R, 100G, 100B, and a surface treatment is therefore performed so as to make at least the insides of the light-emitting layer formation areas A lyophilic again. The solvent used in the three liquid materials 100R, 100G, 100B is applied and dried as the method for the surface treatment. Spray coating, spin coating, and other such methods are possible examples of the method for applying the solvent. The process then advances to the liquid material discharging step.

In the liquid material discharging step, the three liquid materials 100R, 100G, 100B containing the light-emitting layer formation material are provided into the plurality of light-emitting layer formation areas A, as shown in FIG. 14(*d*). The liquid material 100R contains a light-emitting layer formation material for emitting red light, the liquid material 100G contains a light-emitting layer formation material for emitting green light, and the liquid material 100B contains a light-emitting layer formation material for emitting blue light. The deposited liquid materials 100R, 100G, 100B spread over the light-emitting layer formation areas A, and their cross-sectional shapes swell into an arc. The method for discharging a liquid material in the first embodiment described above is used as the method for providing these liquid materials 100R, 100G, 100B. A conventional material suitable for wet coating methods can be used for the light-emitting layer formation materials. The process then advances to the drying/film formation step.

In the drying/film formation step, the solvent components of the discharged liquid materials 100R, 100G, 100B are dried and removed, and a film is formed so that the light-emitting layers 617R, 617G, 617B are stacked on the hole injection/transport layers 617*a* of the light-emitting layer formation areas A, as shown in FIG. 14(*e*). The method for drying the element substrate 601 onto which the liquid materials 100R, 100G, 100B are discharged is preferably reduced-pressure drying, in which the evaporation rate of the solvents can be kept substantially constant. The process then advances to the cathode formation step.

In the cathode formation step, the cathode 604 is formed so as to cover the surfaces of the light-emitting layers 617R, 617G, 617B and the upper layer banks 618*b* of the element substrate 601, as shown in FIG. 14(*f*). Ca, Ba, Al, or another such metal; or LiF or another such fluoride is preferably combined as the material of the cathode 604. It is particularly preferable to form a film of Ca, Ba, or LiF having a small work function on the side nearer to the light-emitting layers 617R, 617G, 617B, and to form a film of Al or the like having a large work function on the side farther from the layers. A protective layer of $SiO_2$, SiN, or the like may also be stacked on top of the cathode 604. The cathode 604 can thereby be prevented from oxidizing. Examples of the method for forming the cathode 604 include vapor deposition, sputtering, CVD, and other methods. Vapor deposition is particularly preferred for its ability to prevent damage from the heat of the light-emitting layers 617R, 617G, 617B.

In the element substrate 601 prepared in this manner, the necessary amounts of liquid materials 100R, 100G, 100B are provided without discharge irregularities to the corresponding light-emitting layer formation areas A, and the element substrate 601 has light-emitting layers 617R, 617G, 617B that have substantially constant film thicknesses after drying/film formation.

The effects of the second embodiment described above are as follows.

(1) In the method for manufacturing the light-emitting element part 603 of the second embodiment described above, in the step of discharging the liquid materials 100R, 100G, 100B, the method for discharging a liquid material of the first embodiment was used to discharge the liquid materials 100R, 100G, 100B as droplets into the light-emitting layer formation areas A. Therefore, discharge irregularities caused by nonuniformity in the discharge characteristics of the nozzle rows 22*a*, 22*b* of the droplet discharge heads 20 are reduced, and light-emitting layers 617R, 617G, 617B are obtained that have substantially constant film thicknesses after drying/film formation.

(2) If the organic EL display device 600 is manufactured using the method for manufacturing the light-emitting element part 603 of the second embodiment described above, the resistance of each light-emitting layer 617R, 617G, 617B is substantially constant because the film thicknesses of the light-emitting layers 617R, 617G, 617B are substantially constant. Consequently, when a drive voltage is applied to the light-emitting element part 603 by the circuit element part 602 and light is emitted, light emission irregularities, brightness irregularities, and other such problems caused by resistance irregularities in each light-emitting layer 617R, 617G, 617B are reduced. Specifically, it is possible to manufacture an organic EL display device 600 that has few light emission irregularities, brightness irregularities, and other such problems, and that has a good visual display quality.

In addition to the embodiments described above, various other modifications can be made. Modifications are presented and described hereinbelow.

Modification 1

In Examples 1 through 4 of the method for discharging a liquid material of the first embodiment described above, the waveform selection applied to adjacent nozzles 22 associated with the film formation areas 2 may be varied with each different liquid material discharged. It is thereby possible to inhibit streaked discharge irregularities in the main scanning direction caused by nonuniformity in the discharge characteristics of the nozzle row from being made conspicuous by discharges of the different liquid materials.

Modification 2

In the method for discharging a liquid material of the first embodiment described above, the number of drive waveforms generated per latch is not limited to this option alone. Two drive waveforms, each having a different timing, may be generated per latch, in view of the circuit configuration of the head drive unit 124 for generating the control signal LAT and the channel signal CH. Otherwise, if the configuration of the droplet discharge heads 20 allows for high frequency driving, the number of drive waveforms generated per latch can be further increased to four or more. The number of droplet discharges per unit time can thereby be increased, and the necessary amount of liquid materials can be more efficiently provided into the film formation areas.

Modification 3

In the method for discharging a liquid material of the first embodiment described above, the generation of drive waveforms is not limited to being cyclical. For example, the drive waveforms may be generated in a non-cyclical manner. This causes the discharge conditions to differ with each discharge timing, and the fluctuating state of the droplet discharge amounts therefore changes in the main scanning direction. Fluctuations in the discharged amounts in the main scanning direction are thereby added to the fluctuations in the discharged amounts caused by nonuniformity in the discharge characteristics among nozzles, and discharge amount irregularities can be dispersed two-dimensionally. Specifically, one-dimensional streaked discharge irregularities in the main scanning direction become inconspicuous.

Modification 4

In the method for discharging a liquid material of the first embodiment described above, the plurality of drive waveforms is not limited to having the same shapes and sizes. For example, the drive waveforms of the system numbers 1 through 3 may have different drive voltages. The droplet discharge amounts can thereby be made to fluctuate according to the waveform selection. Specifically, the discharge amount can be dispersed with each droplet discharge.

Modification 5

In the method for discharging a liquid material of the first embodiment described above, the method for discharging a liquid material of Examples 1 through 4 may be combined according to the arrangement of film formation areas 2 in the glass substrate 1 as a discharge target. For example, a case in which film formation areas 2 of different sizes in one glass substrate 1 are divided Up and arranged according to size, a case in which the stripe directions of the film formation areas 2 are divided into the X-direction and the Y-direction and arranged, and other cases are possible aspects. Specifically, the optimal method for discharging a liquid material can be used and the necessary amount of liquid material can be provided in a stable discharge amount to the film formation areas 2, according to the number of nozzles 22 associated with the film formation areas 2.

Modification 6

In the method for manufacturing the color filter 10 of the first embodiment described above, the arrangement of the colored layers 3R, 3G, 3B of three colors is not limited to stripes. The method for discharging a liquid material described above can still be applied if the arrangement is a mosaic pattern in which colored layers 3 of the same color are arranged at a slant, or a delta pattern in which the colored layers 3 of each color are arranged at positions at the peaks of triangles. The colored layers 3 are not limited to three colors, and may be multicolored including colors other than R, G, and B.

Modification 7

The method for manufacturing the light-emitting element part 603 of the second embodiment described above is not limited to forming light-emitting layers Lu of three colors. For example, a monochromatic configuration of white, red, or another color may be used. An illumination device or photosensitive device containing a monochromatic organic EL element can thereby be provided.

Modification 8

The method for manufacturing a device to which the method for discharging a liquid material of the first embodiment can be applied is not limited to a method for manufacturing a color filter or a method for manufacturing an organic EL element. For example, the method may also be applied to a method for manufacturing metal wiring, in which a liquid material containing an electroconductive material is discharged into film formation areas on a substrate, and wiring having a specific pattern is formed; a method for manufacturing an orientation film, in which a liquid material containing an orientation film forming material is discharged into film formation areas on a substrate, and an orientation film is formed; and other such manufacturing methods.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for discharging a liquid material comprising:

performing a scan by moving, in a scanning direction, a discharge target having a plurality of film formation areas aligned in the scanning direction and a plurality of nozzles aligned in a nozzle row direction forming a nozzle row with respect to each other, the scanning direction intersecting the nozzle row direction; and discharging a liquid material containing a functional material as droplets from the nozzles onto the film formation area by selectively applying one of a plurality of drive waveforms generated using time division to an energy generation element of each of the nozzles in synchronization with the scan so that each of the film formation areas receives the liquid material discharged from at least two of the nozzles, the discharging of the liquid material including applying a first drive waveform to a first nozzle of the nozzle row associated with the film formation areas and a second drive waveform having a different discharge timing from the first drive waveform to a second nozzle of the nozzle row associated with the film formation areas with the second nozzle being adjacent to the first nozzle, and changing a combination of the first and second drive waveforms selected from the drive waveforms at least once with respect to adjacent ones of the film formation areas aligned in the scanning direction.

2. The method for discharging a liquid material according to claim 1, wherein the performing of the scan includes performing the scan for a plurality of times, and the discharging of the liquid material includes changing the combination of the first and second drive waveforms selected from the drive waveforms with each scan.

3. The method for discharging a liquid material according to claim 1, wherein the discharging of the liquid material includes changing the combination of the first and second drive waveforms selected from the drive waveforms with respect to each different liquid material discharged from the nozzles.

4. The method for discharging a liquid material according to claim 1, wherein the discharging of the liquid material includes discharging the droplets into each of the film formation areas in the scanning direction from each of the first and second nozzles, and changing the combination of the first and second drive waveforms selected from the drive waveforms with respect to each droplet discharge.

5. The method for discharging a liquid material according to claim 1, wherein the discharging of the liquid material includes applying a part of the drive waveform that is generated in a prescribed cycle to the energy generation element.

6. The method for discharging a liquid material according claim 1, wherein the discharging of the liquid material includes applying a part of the drive waveform that is generated within one cycle to the energy generation element.

7. The method for discharging a liquid material according to claim 1, wherein the discharging of the liquid material includes applying a part of the drive waveform that is generated non-cyclically to the energy generation element.

8. A method for manufacturing a color filter having a colored layer with at least three colors formed in a plurality of film formation areas partitioned on a substrate, the method comprising:

discharging the liquid material of at least three colors containing a colored material onto the film formation areas using the method for discharging a liquid material according to claim 1; and solidifying the liquid material discharged onto the substrate to form the colored layer with at least three colors.

9. A method for manufacturing an organic EL element having at least a light-emitting layer formed a plurality of film formation areas partitioned on a substrate, the method comprising:

discharging the liquid material containing a light-emitting layer formation material into the film formation areas using the method for discharging a liquid material according to claim 1; and solidifying the liquid material discharged onto the substrate to form the light-emitting layer.

* * * * *